US007568853B2

(12) United States Patent
Laufer

(10) Patent No.: US 7,568,853 B2
(45) Date of Patent: Aug. 4, 2009

(54) DOCUMENT BINDER ASSEMBLY

(75) Inventor: David Laufer, Roswell, GA (US)

(73) Assignee: Golux LLC, Atlanta, GA (US)

( * ) Notice: Subject to any disclaimer, the term of this patent is extended or adjusted under 35 U.S.C. 154(b) by 563 days.

(21) Appl. No.: 10/846,806

(22) Filed: May 13, 2004

(65) Prior Publication Data

US 2005/0254885 A1 Nov. 17, 2005

(51) Int. Cl.
*B42F 13/00* (2006.01)

(52) U.S. Cl. ..... 402/73; 402/76; 281/40; 281/29

(58) Field of Classification Search ..... 281/21.1, 281/29, 34–38, 40, 44, 45; 412/3, 4; 402/73, 402/76

See application file for complete search history.

(56) References Cited

U.S. PATENT DOCUMENTS

| | | | | | |
|---|---|---|---|---|---|
| 851,546 | A * | 4/1907 | Mudd | 229/72 |
| 2,078,988 | A * | 5/1937 | Amato | 402/45 |
| 4,711,469 | A * | 12/1987 | Bogar | 281/27.2 |
| 4,932,679 | A | 6/1990 | Mayer et al. | |
| 5,186,565 | A * | 2/1993 | Jack | 402/79 |
| 5,445,467 | A * | 8/1995 | Peleman | 402/57 |
| 5,697,646 | A * | 12/1997 | Venegas | 281/37 |
| 5,944,352 | A * | 8/1999 | Crouch et al. | 281/21.1 |
| 6,234,701 | B1 | 5/2001 | Karten et al. | |
| 6,340,178 | B1 * | 1/2002 | Nakanishi et al. | 281/45 |
| 6,386,784 | B1 * | 5/2002 | Ruble | 402/60 |
| 6,412,819 | B1 * | 7/2002 | Paine et al. | 281/29 |
| 6,435,753 | B1 | 8/2002 | Gusack | |
| 6,659,675 | B2 | 12/2003 | Rew | |
| 6,669,392 | B2 * | 12/2003 | Rebora | 402/8 |
| 6,682,248 | B2 * | 1/2004 | Lockhart | 402/73 |
| 6,923,590 | B2 * | 8/2005 | Ward et al. | 402/70 |
| 2002/0131811 | A1 | 9/2002 | Lockhart | |

FOREIGN PATENT DOCUMENTS

| | | | |
|---|---|---|---|
| WO | WO/9416906 | * | 8/1994 |

* cited by examiner

*Primary Examiner*—Dana Ross
*Assistant Examiner*—Jamila Williams
(74) *Attorney, Agent, or Firm*—Alston & Bird LLP

(57) ABSTRACT

Disclosed is a binder assembly and an improved method for binding paper documents, particularly short run and full dress documents (SRFDD) that are widely used in numerous contexts, including competitive bidding and investment solicitation. The binder assembly comprises a slide for supporting the bound document, a cover for enclosing the document, and a binder for binding the document. The cover is flexible and printable with a width-adjustable spine portion for titling and identifying the bound document with indicia. The binding method provides for relatively rapid, yet flexible and inexpensive production of bound documents with professional appearance.

5 Claims, 26 Drawing Sheets

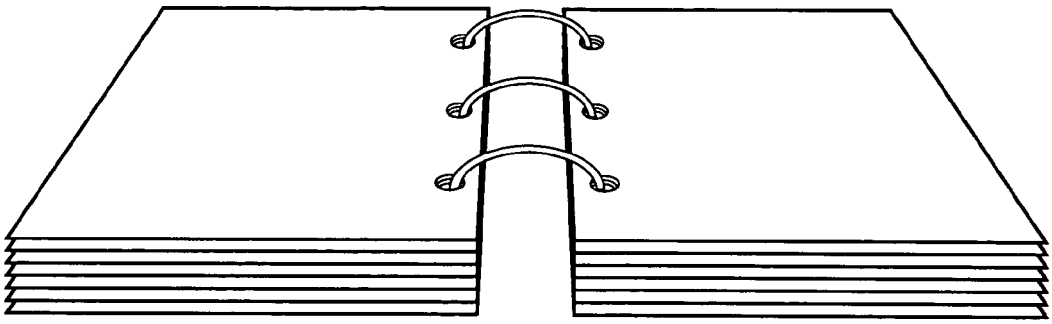
Prior Art Fig. 1A
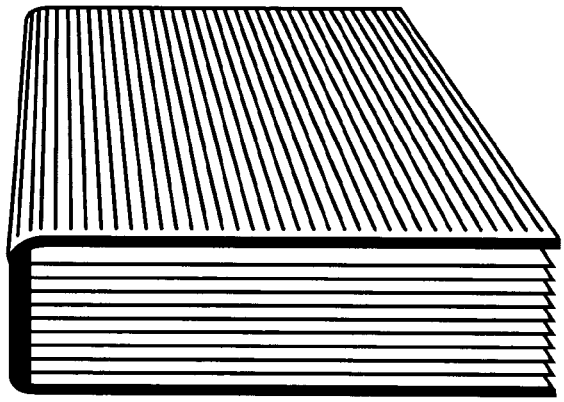
Prior Art Fig. 1B
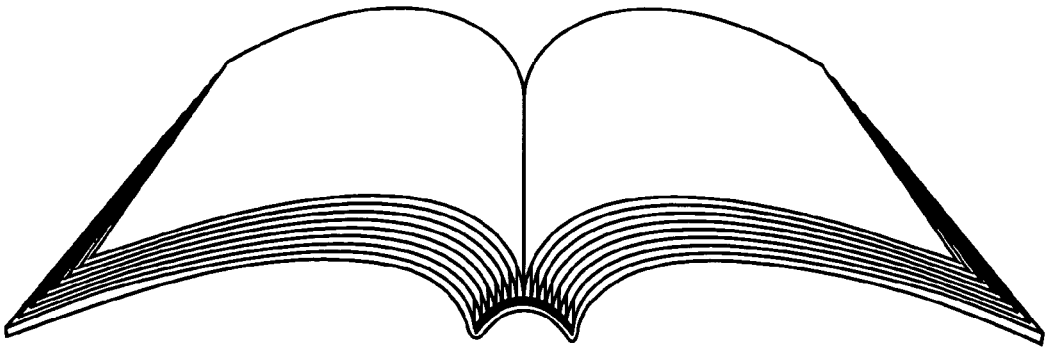
Prior Art Fig. 1C

Fig. 4A-B

DOCUMENT BINDER ASSEMBLY

FIELD OF THE INVENTION

The present invention generally relates to apparatuses and methods for binding documents. Such documents can include, but are not limited to, reports, analyses, proposals, marketing materials, brochures, manuals, guides, prospectus, booklets, and other such items.

BACKGROUND OF THE INVENTION

Organizations often require documents in the course of their businesses for a variety of reasons. As mentioned above, these documents may be in the form of reports, analyses, proposals, marketing materials, brochures, manuals, guides, prospectus, booklets, and other items. Often, in such contexts, documents are required in limited quantities. In addition, the document content is often dynamic over the course of its preparation, and thus may evolve as numerous versions or drafts up until the point of releasing the final document for use by its intended recipients. For example, in the context of commercial bidding, there is often a significant need for flexibility in terms of the content of the document given the dynamic nature of negotiations. In addition, in the commercial bidding context, there is often a significant need for rapid production and binding of documents, generally within a very limited time, to avoid unduly protracting negotiations, which may in effect lead to lost opportunities. In normal negotiated or interactive contexts, only a few minutes to a few days may mean the difference as to whether a negotiation or bid is successfully concluded. But despite severe time constraints, it will be advantageous if the documents to be presented or distributed possess very professional appearance and be of as high quality as possible. Oftentimes, in addition to the document substance, the exterior appearance of the document may itself have a significant influence on the document recipients' final decision. For example, a decision maker may be so constrained by time that that person can only pick and read a few from a large number of competing documents. This person's selection is likely to be based in large part on the best first impression upon the exterior appearances of the received documents. In view of these facts, a document producer normally desires to make the presented document more noticeable and impressive in its appearance, easier to navigate to find information of interest, durable so as to maintain its presentable appearance even though it may be subject to rough handling or handling by numerous persons over the course of its use, all without significantly increasing production cost. These are often competing objectives that are each difficult to attain in a manner that avoids adverse impact on other desirable objectives for the document to be produced. Therefore, an improved method is needed for binding documents that are to be printed within a limited amount of time with the expectation of high quality, even though the documents are to be produced in relatively low quantities. This category of documents is hereinafter referred as "Short Run Full Dress Documents" (SRFDD).

More specifically, it would be desirable from the standpoint of a document producer to provide a binder assembly and method to attain one or more, and preferably all, of the following objectives: (1) Short Run, meaning that the producer may produce SRFDD, typically between 5 and 100 copies, on a regular basis, with the ability to reuse the formats and content; (2) Quick Turn, meaning that SRFDD can be produced within limited time, and can be revised even after printing and binding; (3) Full Dress, meaning that the producer is allowed to personalize the SRFDD cover with names or titles tailored to particular recipients, and make the SRFDD easily identifiable in its stored position, either standing vertically or stacked horizontally, so that high standards of quality or service are demonstrated to reflect favorably upon the producer; and (4) Cost Control, meaning that the producer can control the unit cost at a moderate level by standardizing many components in producing and binding SRFDD. From the perspective of a recipient, the improved binder assembly should have the following characteristics: (1) document pages/sheets lay flat when the document is open; (2) document sheets/pages and covers are mechanically connected so that the enclosed pages/sheets do not fall out and their intended sequence is preserved; (3) the document spine is imprinted with information useful to the recipient, such as Project Name, Contract Number, Client Name, Logo or any other indicia; (4) the document is easily identifiable in its stored position, either standing vertically or stacked horizontally; and (5) the binding adds little bulk to the document. As explained below, all these objects required by both the document producer and recipient can not be completely realized by prior binding methods.

FIGS. 1A-1C illustrate the primary problems with prior art binding methods. The bound document in FIG. 1A has a ring binder assembly that enables the document to lay flat when opened. However, the pages are generally more difficult to turn as compared to a book binding, requiring that such pages be slid along the rings from one side of the binder assembly to the other. Further, due to resistance of the rings when turning the pages, the pages tend to tear. In addition, the binder incorporates a relatively large quantity of metal and other materials that are relatively expensive, significantly increasing the cost of the documents to be produced. Also, the configuration of the cover is such that it cannot readily be printed. Instead, the only customized printing that can be done is to print a tag of limited size for insertion into a pocket on the spine of the ring binder assembly. The result is that the binder assembly has a generic appearance which is unlikely to impress the recipient. Further, using ring binders, a series of documents cannot be stacked flat unless the documents inside happen to be the same thickness as the spine. Hence, if ring binders are stacked, they tend to tilt on each other so that very few can be stacked until the uppermost binder slips off. It would be desirable to provide documents that could be readily stacked in an organized fashion.

As seen in FIG. 1B, the "book-like" or book-bound documents provide a relatively flat spine for bearing titles, marks, or any other indicia thereon to identify the enclosed document. However, such a book cannot lay flat when opened, as shown in FIG. 1C. Rather, it tends to close automatically due to the manner in which it is bound along its spine. This is a source of considerable difficulty and frustration for readers who have to hold the document open by hand while reading the content.

In part to resolve the problem of hiding the binder, many document producers create a jacket or wrap to go around the finished documents. Standard ring binders generally have been avoided by SRFDD producers, primarily because they are bulky, difficult to dress up to improve their appearance, and require too long of a lead time to customize their imprinting. Imprinting custom graphics on the outside of the ring binder in short runs is prohibitive in terms of both cost and time. Also, the ring binder can be readily opened. In the event that the ring binder is inadvertently opened, the document sheets therein can be spilled out, resulting in loss of correct order of the document sheets, and the need to reorder the document sheets and rejoin them with the ring binder. One option for hiding binder is to create a single piece jacket to connect to the binder before the first page and after the last page of the enclosed document to hide the binder. But connecting the jacket to the hardware in two places causes the jacket to buckle or crease when the document is opened, due to the dimensional changes in the document (i.e., the stack of document sheets) in its opened and closed configurations. Some document producers have created wrap covers for their SRFDD needs that are printed lightweight paper board (e.g., 0.012" in thickness (" refers to an "inch" which is equal to 2.54 centimeters)) and punched so that the binder shows only on the back cover. This does hide the binder when the document is closed, but exposes the binder if the document is opened.

U.S. patent application publication 2002/0131811 presents another configuration for hiding binder to enhance the appearance of a report. This application discloses a report cover which can be used to with a report bound by a flexible comb binding. An insert is bound on the backside of the report (i.e., document sheets) in the flexible comb binding and then fit within a pocket in the interior backside of the cover. The front and back covers and spine enclose the report and spiral binding to provide an attractive final report appearance. Although meritorious from the standpoint of providing an attractive appearance, insofar as it is applicable to the SRFDD market, this binding has significant shortcomings. For instance, the cover is not attached to the enclosed report in a sufficiently secure manner. Although this binding configuration allows an insert to slide into a pocket defined on the back cover, and has a tab defined on the edge of the slide that can be inserted into a corresponding slot on the edge of the pocket, the report and cover can nonetheless readily come apart when handled by a reader. Furthermore, the cover is made of rigid board which creates several problems deviating from what those skilled in the art would deem desirable characteristics of SRFDDs. First, the rigid board cover adds bulk to the report assembly. To have a lightweight document and save filing space, the recipient would most likely be compelled to discard the cover by removing it from the bound report, which can be done easily enough since they are only loosely connected, hence defeating the document producer's purpose to have an attractive appearance of the report. Second, rigid board covers must be manufactured to accommodate a binder of certain size. Given that the document substance may be constantly changing during preparation of a SRFDD, in many cases, the thickness of such SRFDD may be undetermined until shortly before the document is due to be provided to the recipient. While it is theoretically possible to produce numerous binders of varying spine thickness for a particular project with the intent that one of the binder sizes will ultimately be found suitable, this is not generally a practical option in that the resulting cost of numerous wasted binders would generally be prohibitive. In addition, a rigid board cover cannot be fed into a printer directly. Instead, a flexible substrate must be printed and wrapped around the board. The process of setting up necessary equipment or machinery for printing a substrate and then applying it to the board can be very time-consuming. It also increases production cost due to the specific need for wrapping machines.

By use of relatively flexible sheet material rather than rigid boards to form the cover, the document folder disclosed in the U.S. Pat. No. 6,659,675 allows the cover to be fed through a computer printer for imprinting directly. That patent also employs a relatively rigid stiffener disposed between the front and back panels of the cover to support the folder when stored vertically. However, as illustrated in this patent, the size of the required cover wrap is so large that special printing machines are generally required, which increases assembly cost. Another disadvantage of this folder is that the cover does not completely hide the binder because of the manner in which the binder is mounted upon the back panel. An alternative way of adhering the binder to the back panel, as illustrated in the patent, cures this deficiency, but it gives rise to the concern that the binder may easily slide off from the back cover. Therefore, this patent does not resolve the problems discussed above, but may actually create additional deficiencies and disadvantages.

In light of the above, it would be desirable to provide a binding method for relatively rapid, flexible, and inexpensive production of SRFDDs that allows standardized components to be pre-manufactured, and project-specific or personalized components to be produced in a relatively short period of time even when the document thickness, dimensions, format, graphics and/or style are not determined until shortly before the document is finalized for production.

It would further be desirable to provide a document binder assembly that can accommodate a variety of commonly available binding techniques, which may employ reversible as well as permanent binders, and the employed binders can be of various sizes, without requiring costly mechanical adjustment or customization.

It would further be desirable to provide a binder assembly that mechanically connects the enclosed document to the cover so as to preserve the document order as well as accommodate the dimensional changes of the document in closed and open positions so that the document lays flat for easy reading when it is open.

It would further be desirable to provide a self-supporting binder assembly by means of which the enclosed document can be vertically positioned in horizontally extending rows.

It would also be desirable to provide a cover for hiding the binder as well as for titling and imprinting textual information, symbols, markings, graphics, etc., collectively referred to as 'indicia,' on the cover in a spine area thereof, to make an integral professional appearance of a SRFDD for specific presentation or distribution purposes.

BRIEF SUMMARY OF THE INVENTION

This invention, in its various embodiments, has as its objects to overcome the disadvantages noted hereinabove. Each embodiment of the invention disclosed herein achieves at least one of these objects to provide a significant advantage over previous binders, and may in addition provide further objects and advantages disclosed herein.

A document binder assembly in accordance with the invention is useful for enclosing and retaining a multiplicity of sheets constituting a document. In one embodiment, the document binder assembly comprises a slide, cover, and binder. The slide can be substantially planar in configuration. The slide can define an engagement portion on a first side thereof for engaging to the binder, and an insert portion on a second opposite side thereof. The cover can be substantially planar in its configuration. The cover defines a pocket portion at a first side thereof, and an engagement portion at a second opposite side thereof. The cover has hinged folds positioned intermediately relative to the pocket portion and engagement portion. The binder holds, in order, the engagement portion of the slide, the multiplicity of sheets constituting the document, and the engagement portion of the cover, so that the hinged folds on the cover bend to define a substantially flat spine portion for the assembly. The cover is attached to the binder at the engagement portion of the cover. The engagement portion is defined on a foldback portion of the cover that is folded underneath a front portion of the cover that hides the binder. The pocket portion of the cover receives the insert portion of the slide. As the document binder assembly is opened and closed, the slide moves in the cover's pocket portion to enable the binder assembly to lay flat in its opened configuration and to assume a book-shaped configuration with a flat spine in its closed configuration. In one embodiment, the binder assembly can further comprise an additional front cover with an engagement portion attached to the binder between the document sheets and the engagement portion of the cover. The front cover can be adhered to the foldback portion to provide a more secure assembly. The front cover can be transparent to allow for showing of indicia, such as graphics and/or textual information, on a front sheet of the underlying document. Alternatively, or in addition to having transparent portions, the front cover can have an opaque portion that defines one or more openings that align with the graphics and/or text on the front sheet of the underlying document. In another alternative embodiment, the front portion and foldback portion of the cover extend all the way from the binder across the width of the document sheets so that no additional front cover is necessary for covering the document in its closed configuration. An insert sheet having indicia can be positioned between the front portion and foldback portion of the cover such that indicia is aligned with an opening defined on the front portion and can be viewed through the opening. The cover can be sufficiently flexible to be fed through a printer so that it can be printed with indicia on one or more of its front portion, spine portion, and/or back portion defined by folds on the cover.

In one embodiment, an article of the invention comprises a cover with one or more features as described above with respect to the document binder assembly. The cover can be printed with indicia including graphics and/or text using a printer such as a standard desktop printer and/or an office copy machine. To this end, the cover can be formed of relatively lightweight paperboard (e.g., 0.012" in thickness) or the like with sufficient flexibility for use in such printer. In addition, the cover can, at least initially, have a relatively flat configuration that permits it to be fed into a printer for printing of indicia thereon. The cover can be printed with indicia on its front, back, and/or spine portions. In addition, the cover can define biased fold lines for ready folding of the cover to define the front, back, and spine portions of the cover. The biased fold lines can be used to form the spine portion intermediate an engagement portion defined on one side of the cover, that can be attached to a binder. The biased fold lines can also be used to define a pocket portion of the cover on a side opposite to the engagement portion. This pocket portion receives the slide of the above-described binder assembly.

Further disclosed in the present invention is a method for binding a document in a binder assembly. This method comprises the step of feeding a cover into a printing machine to print at least one portion of the cover with indicia. To this end, the cover can comprise a flexible one-piece sheet, which facilitates feeding the sheet through a printer. The cover comprises a pocket portion at a first side thereof, and an engagement portion at a second opposite side thereof, and hinged folds positioned intermediately relative to the pocket portion and engagement portion. The method also comprises binding the engagement portion, a multiplicity of sheets constituting a document, and a slide with a binder. The method further comprises the step of folding the cover so as to form a substantially flat spine corresponding to the thickness of the document, a back portion, a front portion, and a foldback portion in which the engagement portion is defined. In one embodiment, the method comprises attaching a substantially planar cover to the foldback portion, the planar cover enclosing the document, together with the cover.

Additional objectives, features and advantages will be apparent in the written description which follows, while referring to the drawings.

BRIEF DESCRIPTION OF THE DRAWINGS

FIGS. 1A-C are plan views of prior art binding methods;

FIGS. 5A-M provide a series of views of each step, in order, of assembling the document binder of FIG. 2 and making a SRFDD;

DETAILED DESCRIPTION OF THE INVENTION

For the purpose of describing the present invention in detail, certain terms used hereinafter are defined as follows:

"Means for binding" include, but are not limited to, the following: brads, staples, saddle stitching, perfect binding, plastic coil, metal wire coil, plastic comb, plastic post, plastic disk, wire, ring binder, Smythe sewn, kettle stitched process by hand, adhesive, or combinations of the above elements. In the present document binder assembly, such means is applied for binding, in order, the engagement of the slide, a document, and the engagement of the cover.

"Binder" can be any element capable of holding a slide, document and cover together, including any one or combination of the elements listed for the "means for binding."

"Indicia" means alphanumeric characters, numerals, trademarks, any graphic and textual marks.

"Document(s)" include, but are not limited to, reports, analyses, proposals, marketing materials, brochures, manuals, guides, prospectus, booklets, and other such items.

Figure 2:
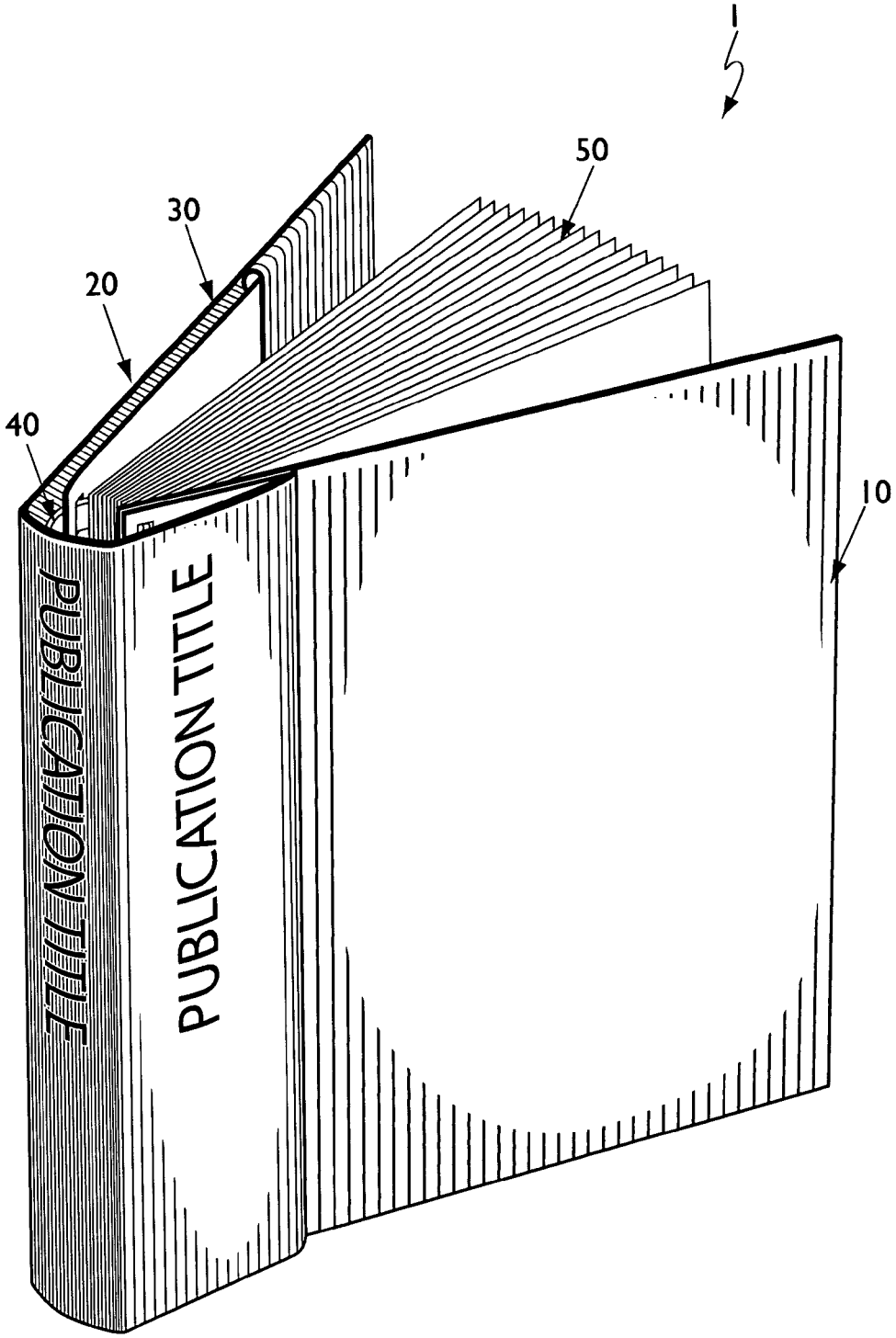
FIG. 2 is a perspective view of a document binder assembly representing one embodiment of the present invention.

Referring now to the drawings, wherein like reference characters designate like or corresponding parts throughout the several views, a document binder assembly 100 forming one embodiment of the present invention will be described. As shown in FIG. 2 the binder assembly 1 comprises a front cover 10, cover 20, slide 30, binder 40, and document 50. Each component is separately illustrated in detail in FIG. 3.

The front cover 10 can be any type of flexible or stiff substrate, such as transparent or non-transparent plastic, paper, paperboard, cardboard, board, and any other similar material. A composite material or laminate of wood particles or paper particles and adhesive can also be suitable for use as the front cover 10. The dimension of the front cover 10 is not generally restricted, but can have a range of sizes commensurate with the standards of various types of document paper, including, for example, 8.5"×11", 8.5"×14", 11"×17" (" refers to an "inch" which is equal to 2.54 centimeters), A2, A3, A4, and others. The front cover 10 can be rectangular-shaped with an engagement portion 11 opposite to a front portion 12, and a top edge 13 opposite to a bottom edge 14. In one embodiment of the present invention, an opening is defined on the cover 10 to allow for viewing of part of the content or any marks or indicia on the first page of the document 50 underneath the front cover 10. An array of punched or machined apertures 15 are defined at spaced locations along the engagement portion 11 to receive a plurality of rings 41 of the binder 40. In one embodiment, each one of the apertures 15 can be defined to be rectangular. Functionally, the apertures 15 are defined in the engagement portion 11 to permit the rings 41 to pass therethrough with sufficient play to enable the engagement portion 11 to be readily moved in relation to the binder 40 by sliding on the rings thereof, yet sufficiently closely fitting to such rings to hold the cover 10 tightly.

The cover 20 is integrally formed from one piece of flexible sheet material. It can be formed of one of the same materials mentioned above with respect to the front cover 10. It is delineated and defined by a group of vertically parallel folds 61, 62, 63 and 64, resulting in five functionally different portions adjacent to each other. Starting from the very right edge to the left of the cover 20, these portions include, in order, a pocket portion 21 comprising a flap portion of pocket 21, one fastening tab 22*a* defined on the top edge of the pocket portion 21, opposite to the other fastening tab 22*b* defined on the bottom edge of the pocket portion 21. An array of punched or machined apertures 27 are defined at spaced locations along an engagement portion 28 of the back cover 20 to receive the plurality of rings 41 of the binder 40. Similar to the apertures 15 of the front cover 10, the apertures 27 of the cover 20 are sufficiently open to receive the rings 41, yet sufficiently closed that the cover 20 is tightly held to the rings 41 of the binder 40. In one embodiment, each one of the apertures 27 can be defined to be rectangular in shape. Alternatively, the apertures 27 can be defined in virtually any suitable configuration. In one embodiment of the pocket portion 21, the open edge of the fastening tab 22*a* is narrower in width than a linear extent of fold 65*a*, and the open edge of the fastening tab 22*b* is narrower in width than a linear extent of fold 65*b*. The fold 64 extends vertically across the cover 20. The fold 64 is positioned opposite to, and in parallel with, an insert receiving edge 29 of the pocket portion 21. The distance between the fold 64 and the insert receiving edge 29 is the same distance as the width of either fastening tab 22*a* or 22*b*, i.e., the length of either fold 65*a* or 65*b*. A pocket can be formed by first folding fastening tab 22*a* about the fold 65*a* inwardly and folding fastening tab 22*b* about the fold 65*b* inwardly, applying adhesive onto the exposed surfaces of both tabs 22*a* and 22*b*, and then folding the flap portion of pocket 21 about the fold 64 toward the center of the cover 20, thereby the tab 22*a* being adhesively fastened to the top edge of the back portion 23 and the tab 22*b* fastened to the bottom edge of the back portion 23. In alternative embodiments, equivalent fastening means other than adhesive may be applied for securing the tabs 22*a* and 22*b* with the back portion 23. The parallel folds 63 and 64 define the rectangular back portion 23 of a dimension the same or similar to that of the front cover 10. The fold 62 is positioned intermediately relative to the folds 61 and 63, with adjustable distance from the fold 63 to provide flexible width of the spine portion 24 corresponding to the changing thickness of the bound document 50. To this end, the fold 62 can be selected as one of a plurality of biased fold lines 62' defined vertically at horizontally spaced locations in the cover 20. These lines can be defined by crease, stamp, or score lines, for example, which weaken the cover 20 at such positions so that they are predisposed to fold at such lines whereas the other portions of the cover remain relatively stiff. Machinery to form such bias lines in sheet materials is well-known in the art. The front portion 25 is defined between the folds 61 and 62, and the foldback portion 26 is defined between the fold 61 and the engagement portion 28 of the back cover 20. The cover 20 can be engaged to the front cover 10 via the foldback portion 26 to provide a wrap within which the bound document 50 as well as the binder 40 are fully enclosed. The specific process of engaging the cover 20 and the front cover 10 will be discussed in detail below. Alternatively, it is possible not to attach the foldback portion 26 and front cover 10 together, although they are bound adjacent one another by the rings 41 of the binder 40.

The slide 30 can be formed of any suitable sheet material that is relatively rigid or stiff. Such material can comprise, by way of illustration and not limitation, a plastic, e.g., a polyolefin, or a stiff paperboard or cardboard. The slide 30 includes an engagement portion 31 defined along one edge thereof. As so positioned, the engagement portion 31 is opposite to, and in parallel with, an unbound edge 32, and a top edge 33 opposite to, and in parallel with, a bottom edge 34. The top edge 33 and the bottom edge 34 are slightly tapered toward the unbound edge 32. This makes it easier to insert the slide 30 into a pocket formed from the pocket portion 21 on the cover 20. An array of punched or machined apertures 35, rectangular in one embodiment, are defined at spaced locations along the engagement portion 31 in proximity to one edge of the slide 30 to receive the plurality of rings 41 of the binder 40. The slide 30 can function as a stiffener to support the document binder assembly 1 when placed in an upright or vertical position as seen in FIG. 2.

Almost all known suitable means for binding can be employed as the binder 40. In one preferred embodiment of the present invention, a flexible comb binding sold by GBC Co., Northbrook, Ill., is used. This binding has a plastic backing from which extends a series of adjacent plastic loops which each have an unattached, free end. The resiliency of the loops causes the free ends to curl in a circle to engage the backing to form a closed loop. The documents to be bound are punched with rectangular holes along their inner edge to permit a loop to pass through each hole. A machine available from GBC and other sources can be employed to open the loops sufficiently to allow a person to fit the apertures defined in the documents onto the loops. The machine then allows the loops to close, effectively binding the document. GBC comb bindings may have a variety of diameters to accommodate the thickness of different documents. In an alternative embodiment, the present invention uses spiral binding (e.g., spiral wire or plastic coils). Spiral binding can be the same or similar to wire or coil binding used for paper notebooks, note pads, and many documents bound by professional binderies. Such spiral bindings, both metal and plastic, can be threaded through round or rectangular holes, for example, defined in the documents being bound. Additional binding means include metal loops or loop wire binding, and a wire twin loop binding that is commonly used in documents such as schedulers, planners, and calendars, for example. The binder 40 engages each component of the document binder assembly by allowing the plurality of rings 41 to be fed through the multiple aligned arrays of apertures, including, in order, the apertures 27 of the cover 20, apertures 15 of the front cover 10, apertures 51 of the document 50, and apertures 35 of the slide 30.

Figure 4A:
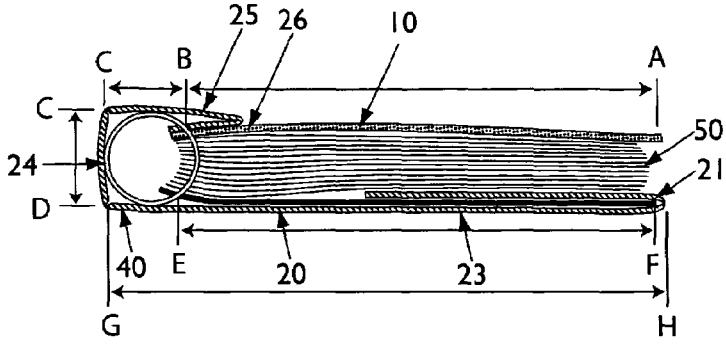
FIG. 4A is a cross sectional view of the document binder assembly of FIG. 2 in its closed configuration.
Figure 4B:
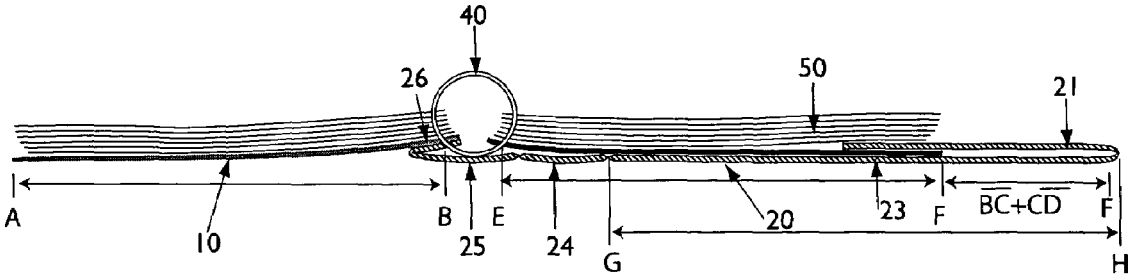
FIG. 4B is a cross sectional view of the document binder assembly of FIG. 2 laying flat in its opened configuration.

As illustrated in FIG. 4A and FIG. 4B, the disclosed invention presents a number of advantageous features over prior document binding assemblies and methods. For example, in the closed position shown in FIG. 4A, the binder 40 is completely hidden within the wrap formed by the cover 20 and front cover 10, and it further touches the spine portion 24 so that the rigidity of the binding coil protects the spine from being crushed. Thus, the present invention provides a "book-like" appearance in its closed configuration. If the binder assembly 1 is moved to its opened configuration, the front cover 10, cover 20, and document sheets constituting the document 50, can slide on the rings 41 to expose the document sheets for viewing. The slide 30 also moves as the binder assembly 1 is opened by sliding outwardly from the pocket portion 21. Because the slide 30 moves outwardly from the pocket by the combined width of the spine portion 24 and the front portion 25, the cover 20, and more generally, the binder assembly 1, lies flat against the surface of a table, for example, upon which it rests. Consequently, the current invention allows an enclosed document to lay flat in its opened configuration, which overcomes a problem common to book-bound documents. As illustrated in FIGS. 4A and 4B, AB is the width of the front cover 10 from its open edge to the binding point B at which the front cover 10 is mechanically connected to the binder 40, CD is the outside diameter of the binder 40 and width of the spine 24, and BC is the linear distance from the binding point B to the folding point C where the front portion 25 and the spine portion 24 adjoin. In the open flat configuration, the document 50, binder 40, and slide 30 can move a distance equal to BC+CD to avoid buckling or creasing the wrap formed from the cover 20 engaged to the front cover 10.

Turning to the drawings from FIG. 5A to FIG. 5M, a step-by-step process and method for assembling the document binder and producing a SRFDD will be described as another embodiment of the present invention.

Figure 5A:
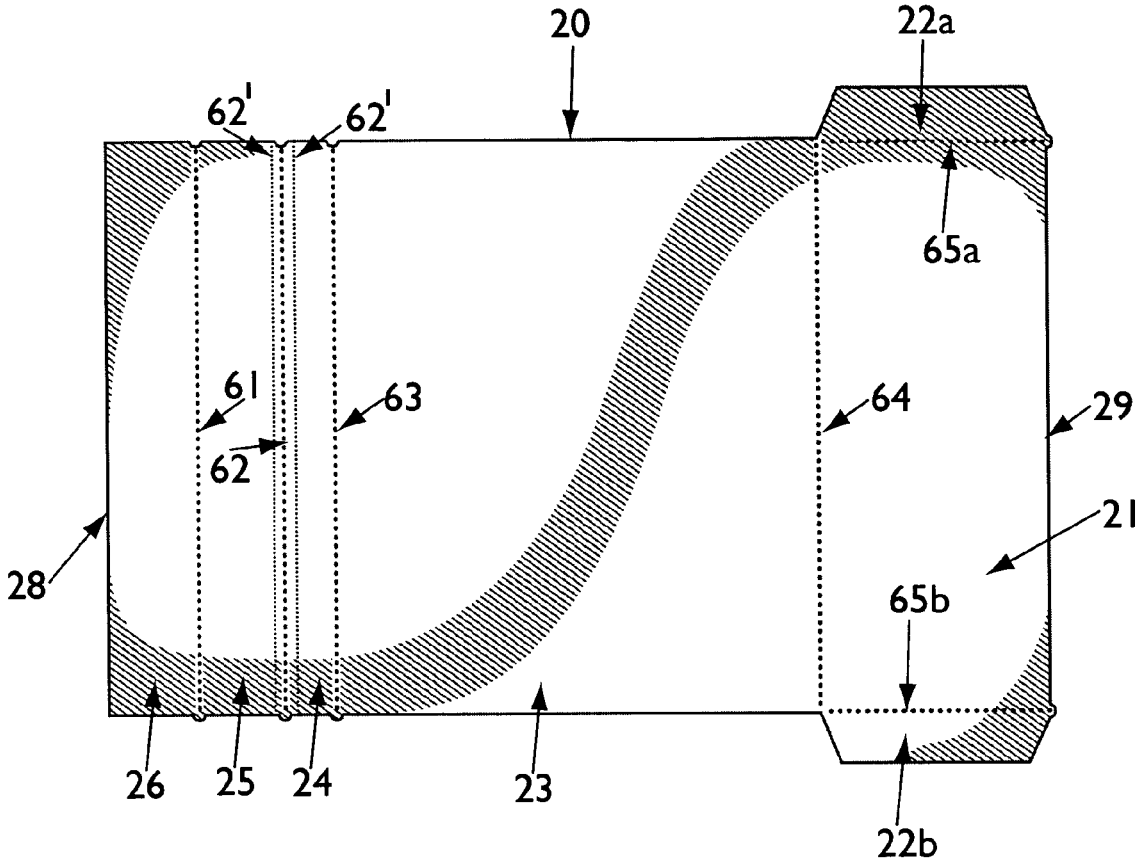
Figure 5B:
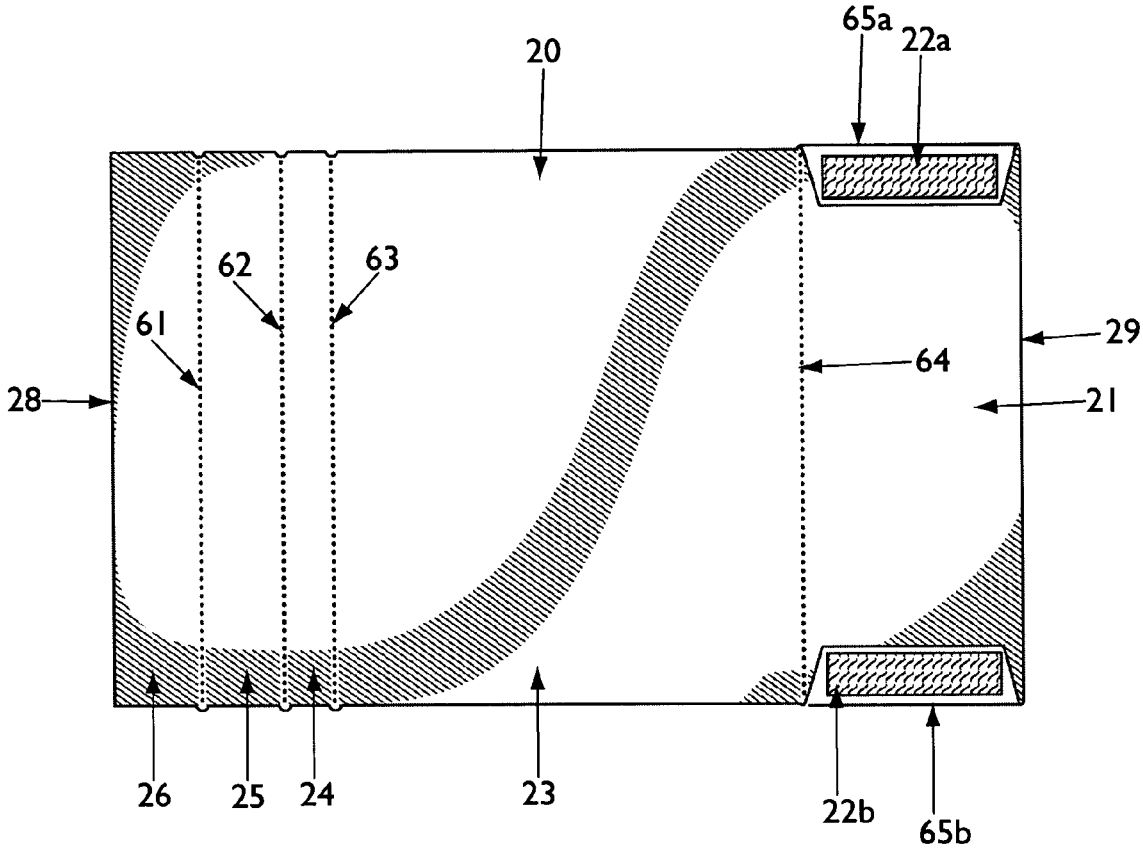

As the first step in FIG. 5A, the cover 20 is integrally formed from one piece of flexible sheet material that is cut by hand or machine to have the illustrated pattern. This sheet is sized to provide vertical width within a certain range commensurate with different standards of document paper, including, for example, 8.5"×11", 8.5"×14", 11"×17" (" refers to an "inch" which is equal to 2.54 centimeters), metric sizes such as A2, A3, A4, and others. The folds 61, 62, 63, and 64 can be readily made by hand or machined on the patterned sheet. The folds 61, 62, 63, and 64 can be made directly, or they may be initially defined as bias lines requiring manual or machine folding in order to bend the cover 20 to form same. Optionally, biased fold lines 62' can be formed on the cover 20 to provide the option of selecting the fold 62 to correspond with the thickness of the document 50. Secondly, to make a pocket on the cover 20, the fastening tabs 22*a* and 22*b* are folded inwardly about the folds 65*a* and 65*b* respectively. Then adhesive is applied onto the surfaces of both tabs 22*a* and 22*b* as shown in FIG. 5B. Subsequently, the flap portion of pocket 21 is bent about the fold 64 toward the center of the cover 20, and the top edge and bottom edge of this portion are pressed against the back portion 23 so that the fastening tabs 22*a* and 22*b* are firmly secured to the back portion 23. These actions result in formation of the pocket portion 21 on the inner side of the cover 20, for receiving the slide 30.

Figure 5C:
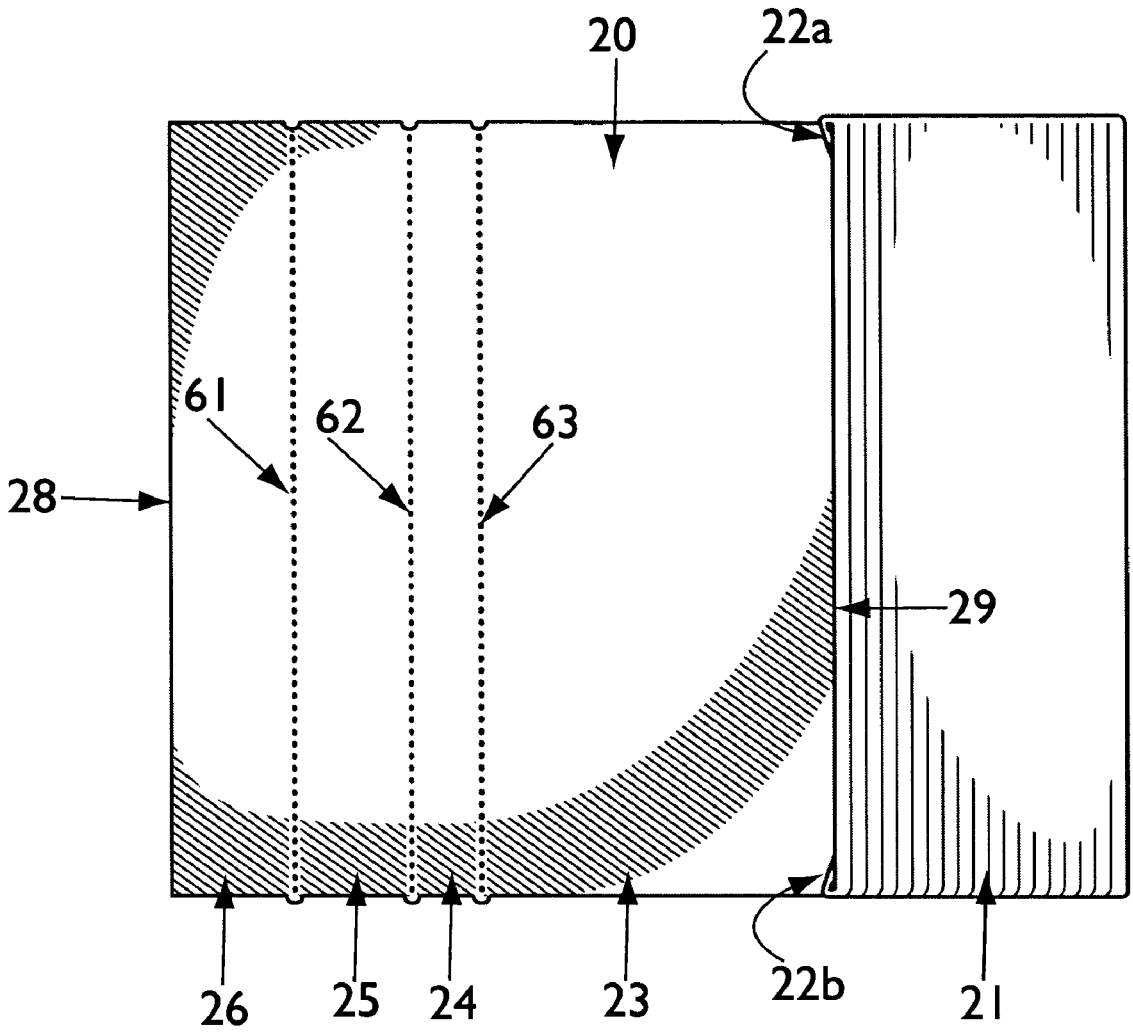

As seen in FIG. 5C, the cover 20 with pocket formed thereon is of a standard size (e.g. 8.5"×11", 8.5"×14", 11"×17" (" refers to an "inch" which is equal to 2.54 centimeters), A2, A3, A4, and others.) and sufficient flexibility to be fed into any printer, typically, a desktop laser printer commonly available even to offices of modest size, or a tabloid extra printer that can print sheets of 12"×8" size. The printed area can be one or more areas of the cover 20, including any, some or all of the portions 23, 24, 25. The printing can be in the form of graphics, textual information, and/or other indicia. As used herein, "and/or" means either one, some, or all of the things meant by the words preceding and succeeding such term. The specific nature of the indicia printed can be readily changed by using a computer to select, modify, and/or create the graphics and/or textual content and layout tailored to the needs of the document recipients. Those of ordinary skill in the art will thus appreciate the value of the binder assembly 1 in the SRFDD market.

Figure 3:
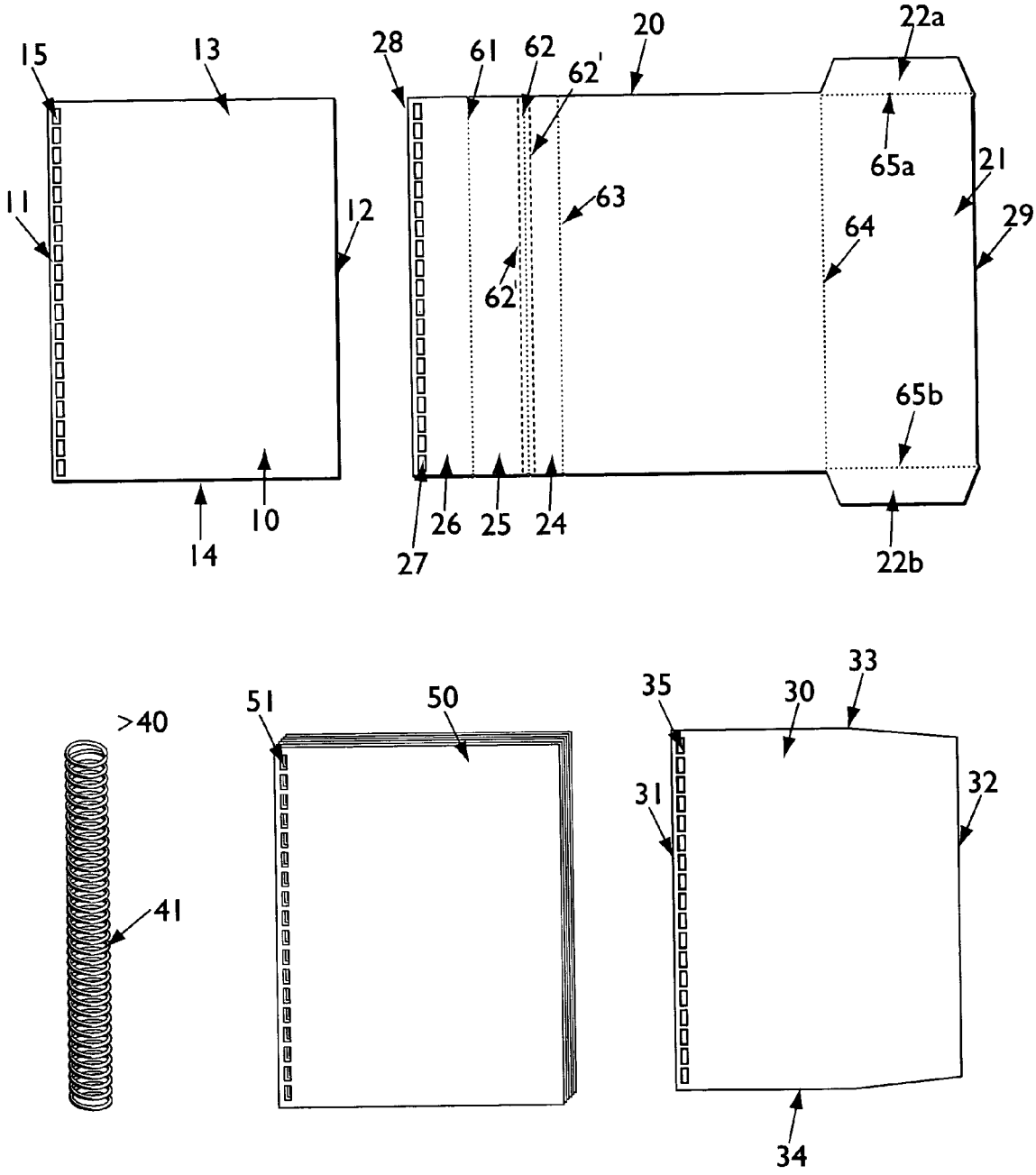
FIG. 3 is a fragmental view of the components to assemble the document binder of FIG. 2.
Figure 5D:
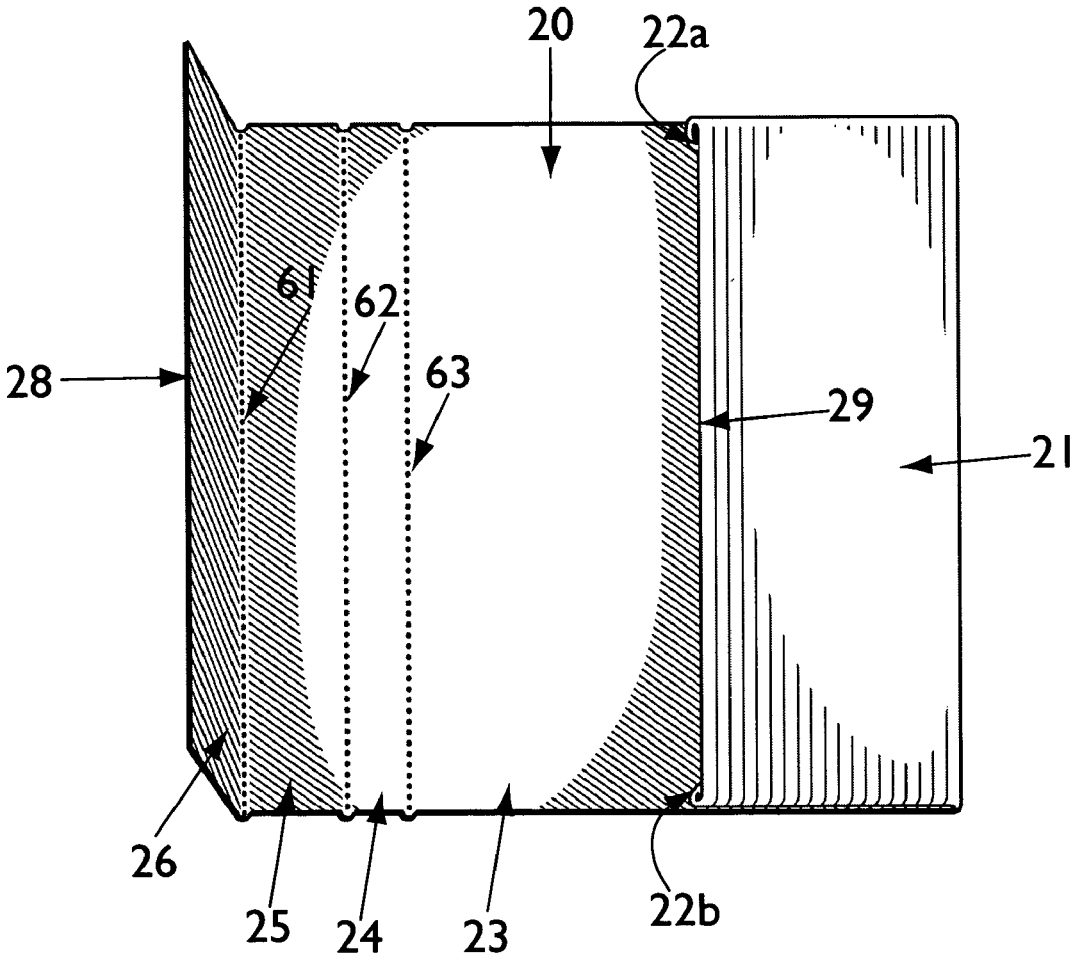
Figure 5E:
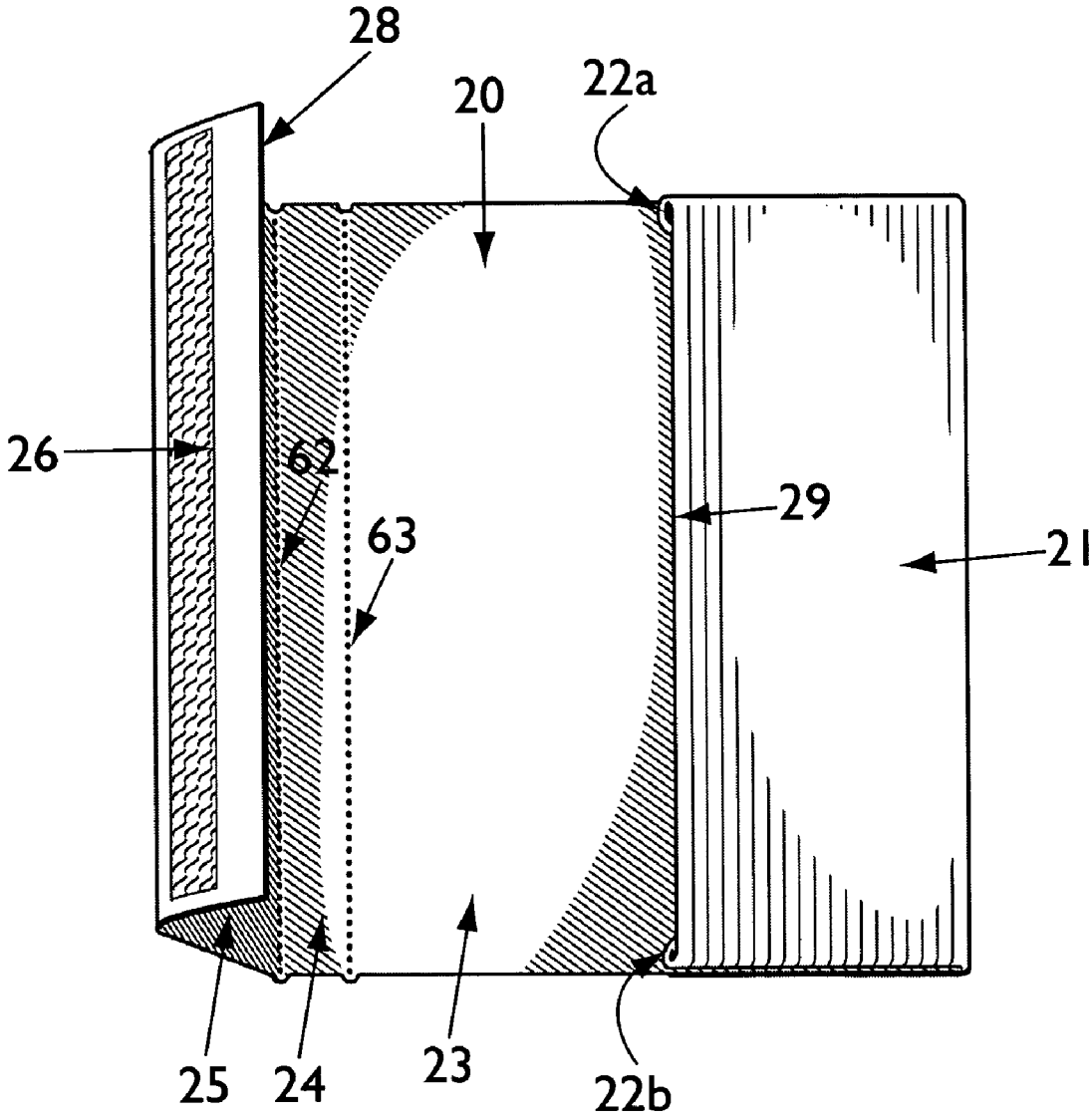
Figure 5F:
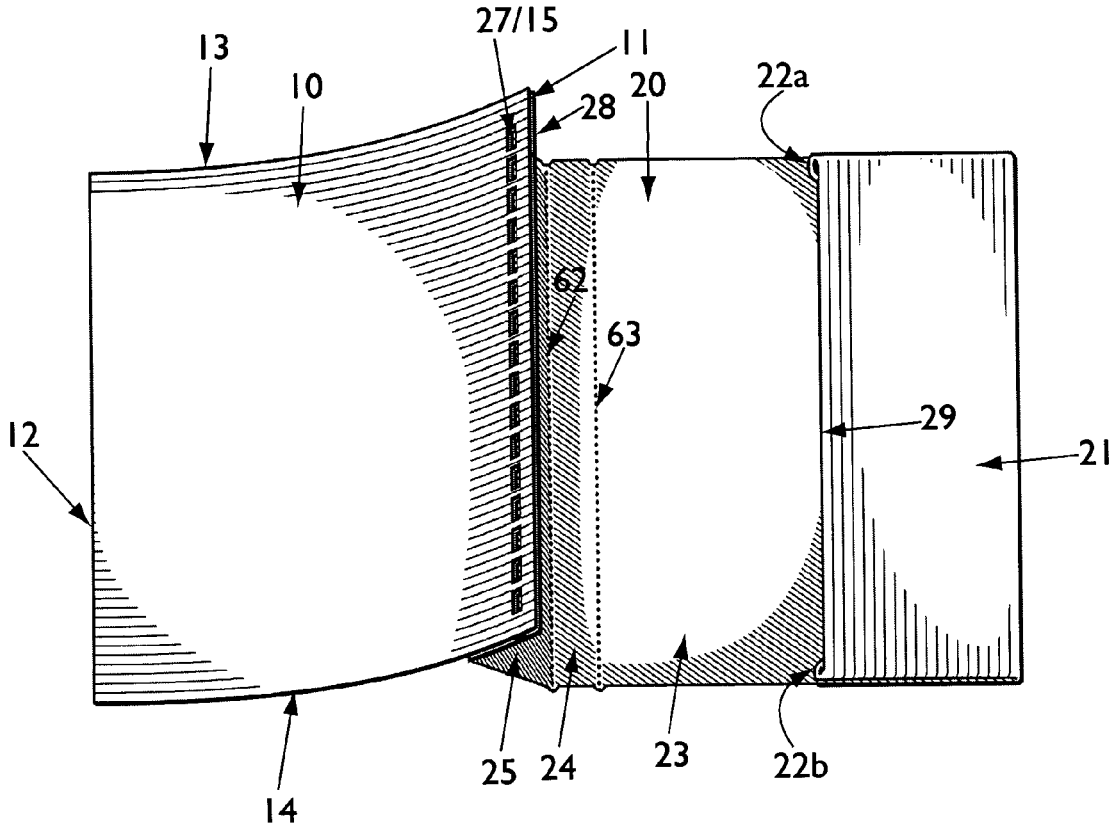
Figure 5G:
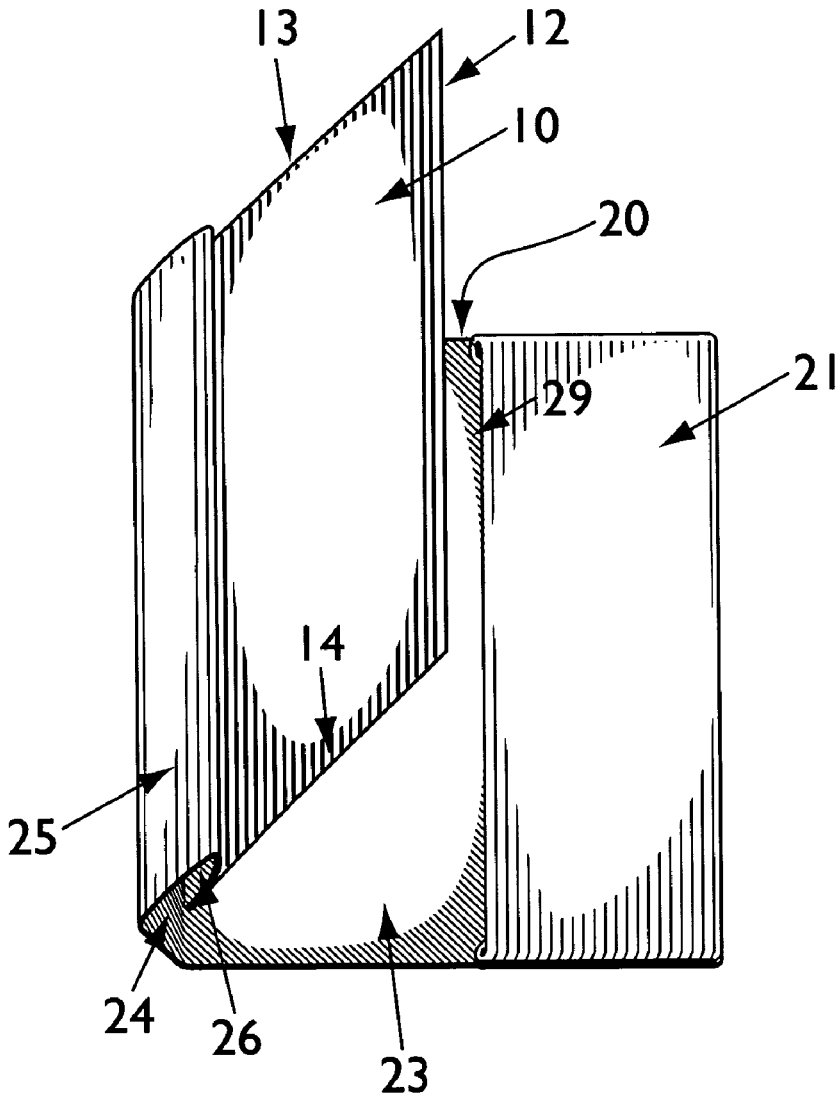

To engage the front cover 10 to the cover 20 for making a wrap, the foldback portion 26 is bent inwardly about the fold 61 that is positioned at a distance (e.g., 1.5 inches, 2 inches, 2.5 inches, etc.) from the engagement portion 28 at the edge of the cover 20, as shown in FIG. 5D. Adhesive is applied to the foldback portion 26 to secure the front cover 10 to the surface of the foldback portion 26, as seen in FIG. 5E. This step is optional, and adhesive can thus be omitted if desired. If adhesive is used, the engagement portion 11 at the side edge of the front cover 10 is aligned with the engagement portion 28 of the cover 20, and the front cover 10 is joined to the foldback portion 26 with the adhesive so that these two portions overlap. The overlapped portion is punched to form an array of apertures (i.e. the apertures 15 and 27 as seen in FIG. 3) along the aligned engagement portions 11 and 28. FIG. 5F illustrates a view of the wrap as a result of the engagement of the front cover 10 to the cover 20. An alternative view of this wrap is shown in FIG. 5G.

Figure 7A:
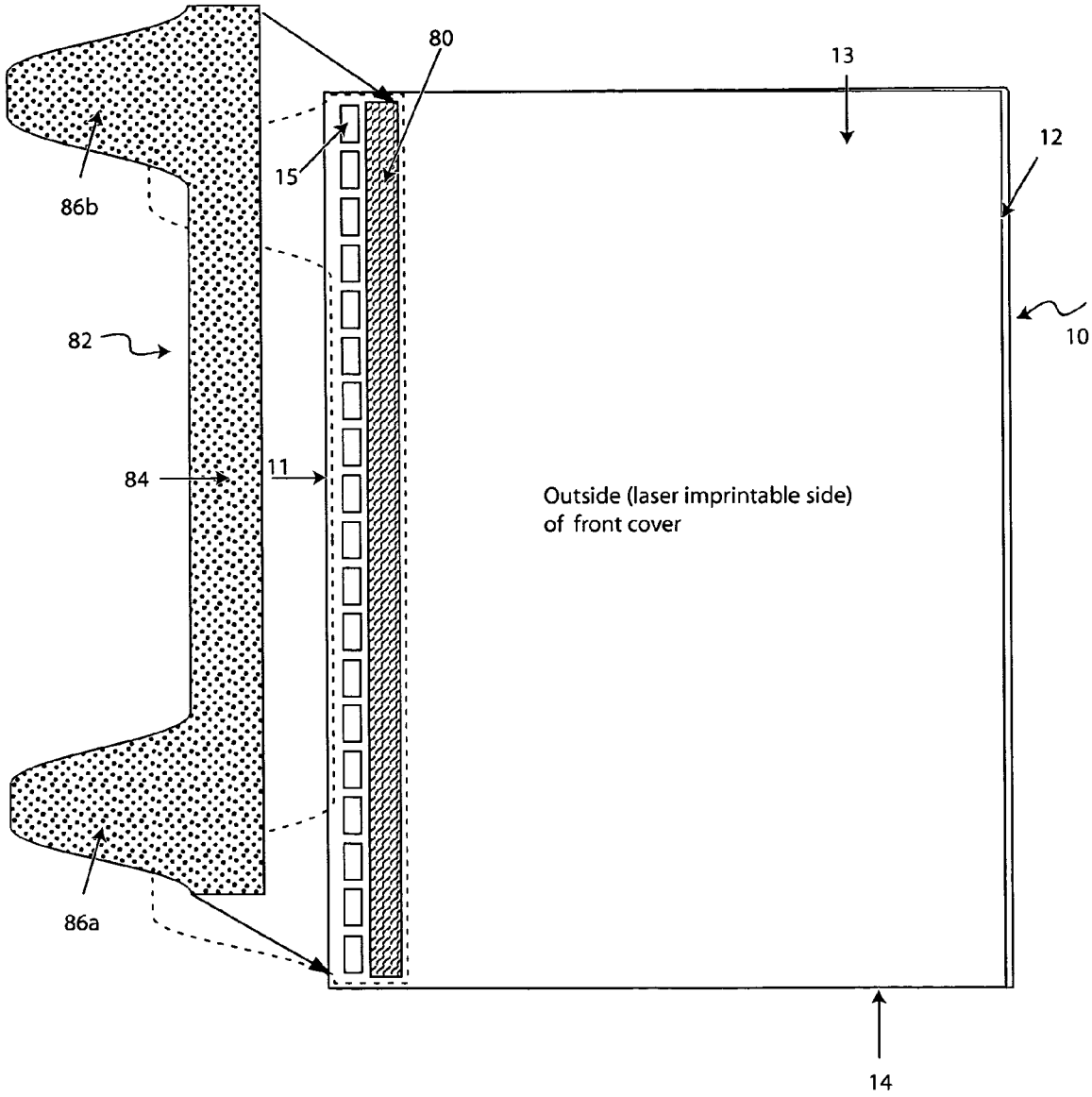
FIGS. 7A-G represent a series of views of an alternative process for performing one specific wrap-making step of the steps as illustrated in FIGS. 5A-M in assembling the document binder of FIG. 2.

The engagement of the front cover 10 and the cover 20 can also be accomplished in accordance with an alternative embodiment of the present invention as demonstrated from FIG. 7A to FIG. 7G. This engagement alternative requires the front cover 10 to have an adhesive strip 80 attached to the upper surface thereof. The adhesive strip 80 comprises adhesive provided in linear or rectangular area of the engagement portion 11 adjacent to and in parallel with the array of pre-punched apertures 15 of the front cover 10. A separate cover sheet 82, which can be made from paper, paper board, plastic, or any equivalent material, is used for protecting the exposed side of the adhesive strip 80 until it is desired to attach the cover sheet 82 thereto. Preferably, this cover sheet 82 is U-shaped, comprising one strip-like cover portion 84 and two customized pull tabs 86*a* and 86*b* extending at spaced locations from the same side of the cover portion 84. An exemplary configuration of this cover sheet 82 is shown in FIG. 7A. The strip-like cover portion 84 is adhered to the adhesive strip 80 as a cover, thus protecting the adhesive strip 80 from being exposed. The two pull tabs 86*a* and 86*b*, as a user-friendly design, are intended to provide finger holds to facilitate removal of the cover sheet 82 away from the adhesive strip 80. Those of ordinary skill in the art can appreciate that many variations other than the specific configuration illustrated in FIG. 7A, are possible for the cover sheet 82. For example, the configuration and spacing of the pull tabs 86*a* and 86*b* can be different than shown in FIG. 7A. In operation, the adhesive strip 80 plus the protective cover sheet 82 is applied to the front cover 20 via a hand-held dispenser, typical of which is a dispenser product carrying the trademark of KleenStick. This type of dispenser is capable of laying down to the surface of an article a line or strip of contact adhesive in a linear or rectangular area of the cover sheet 82 adjacent apertures 15.

Figure 7B:
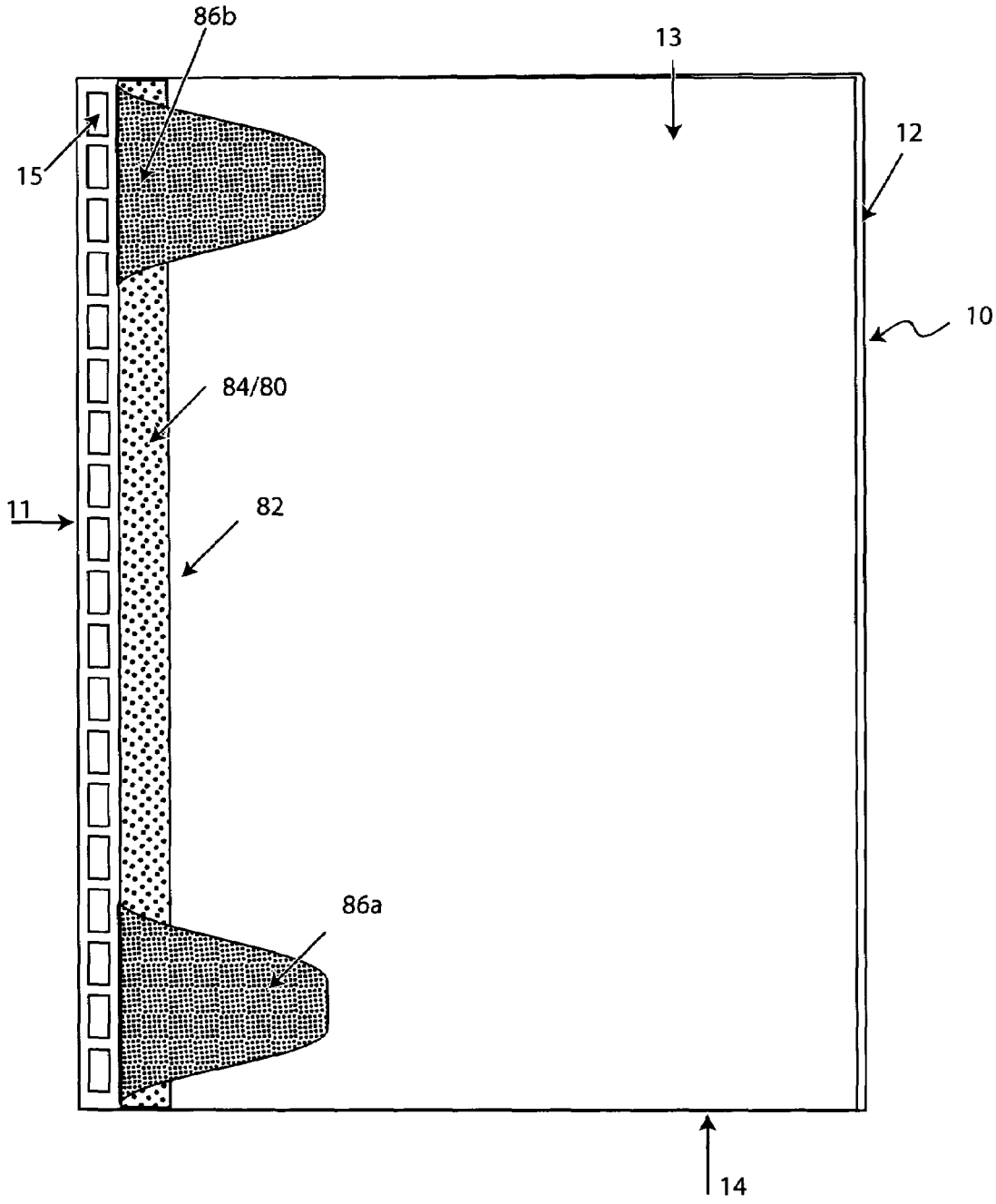
Figure 7C:
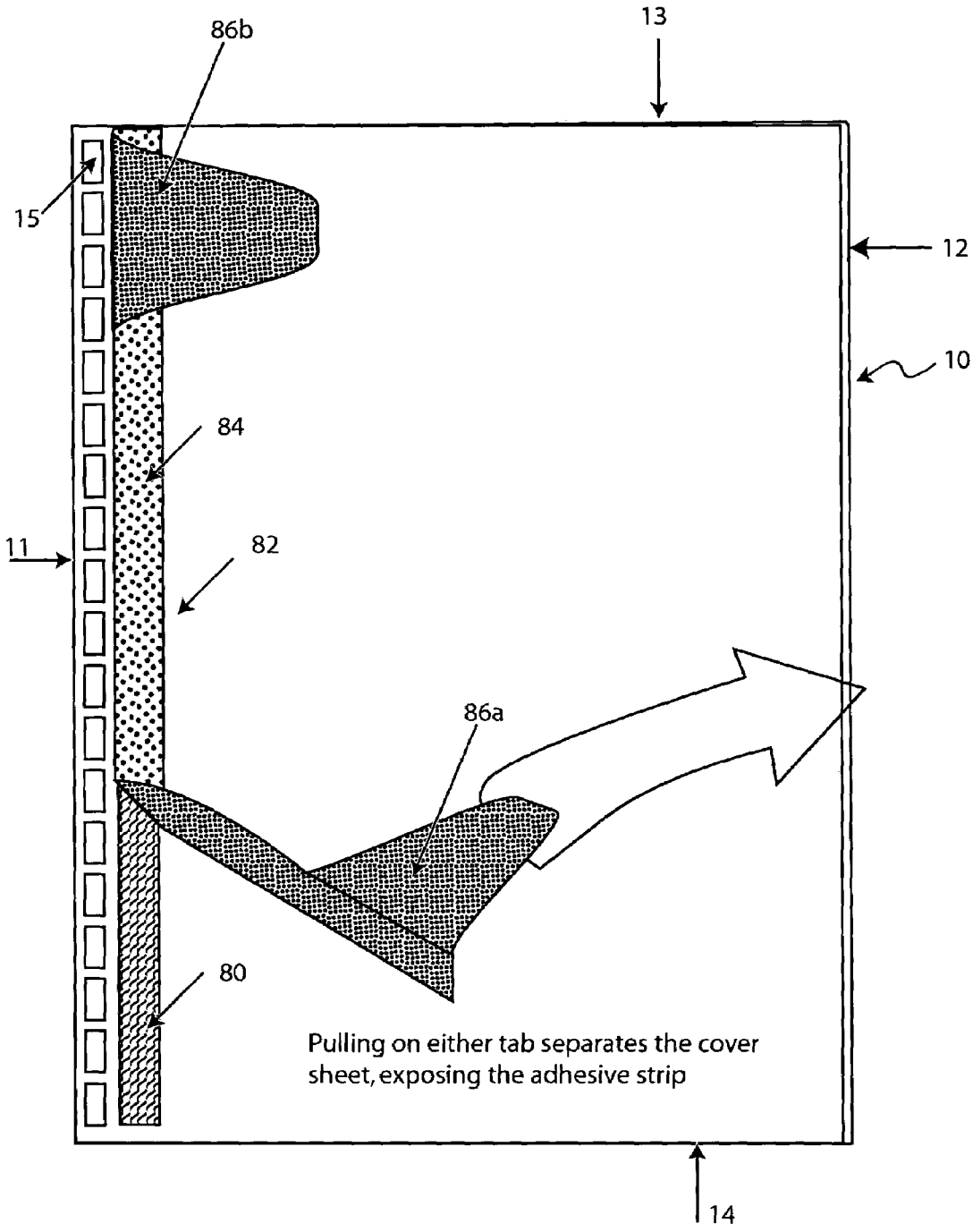
Figure 7D:
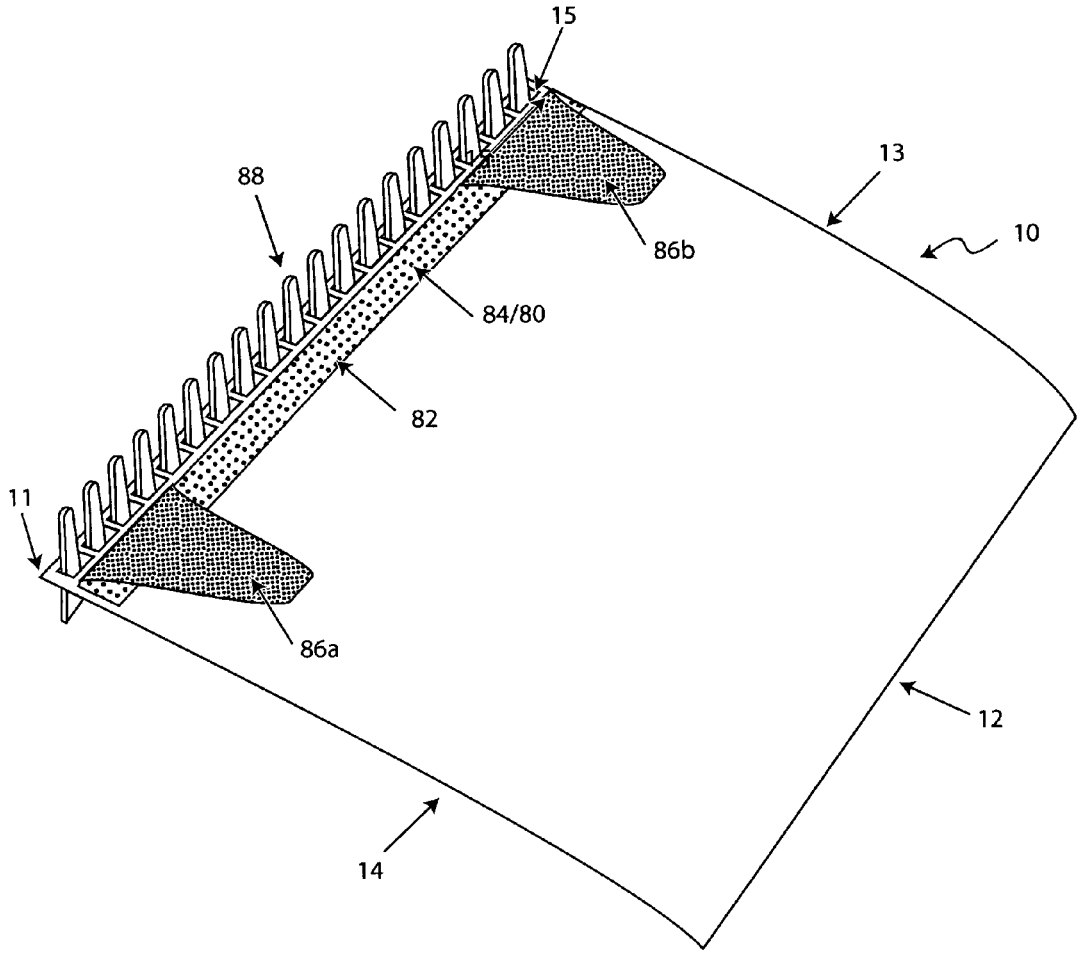
Figure 7E:
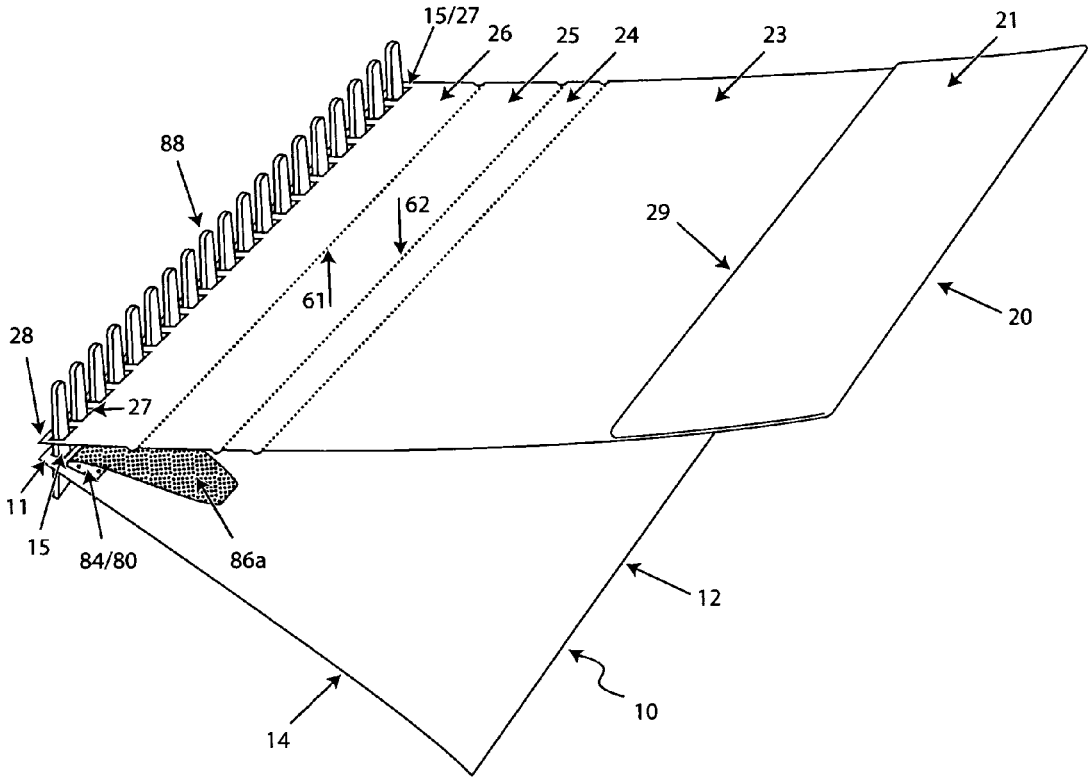
Figure 7F:
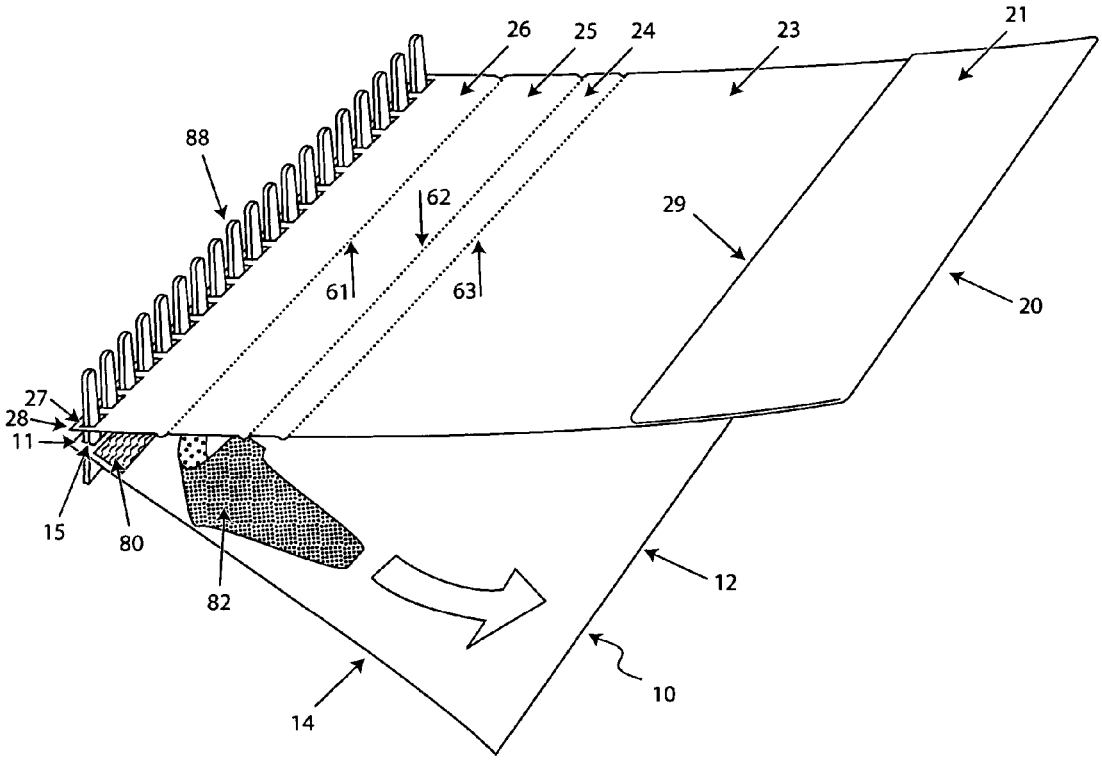
Figure 7G:
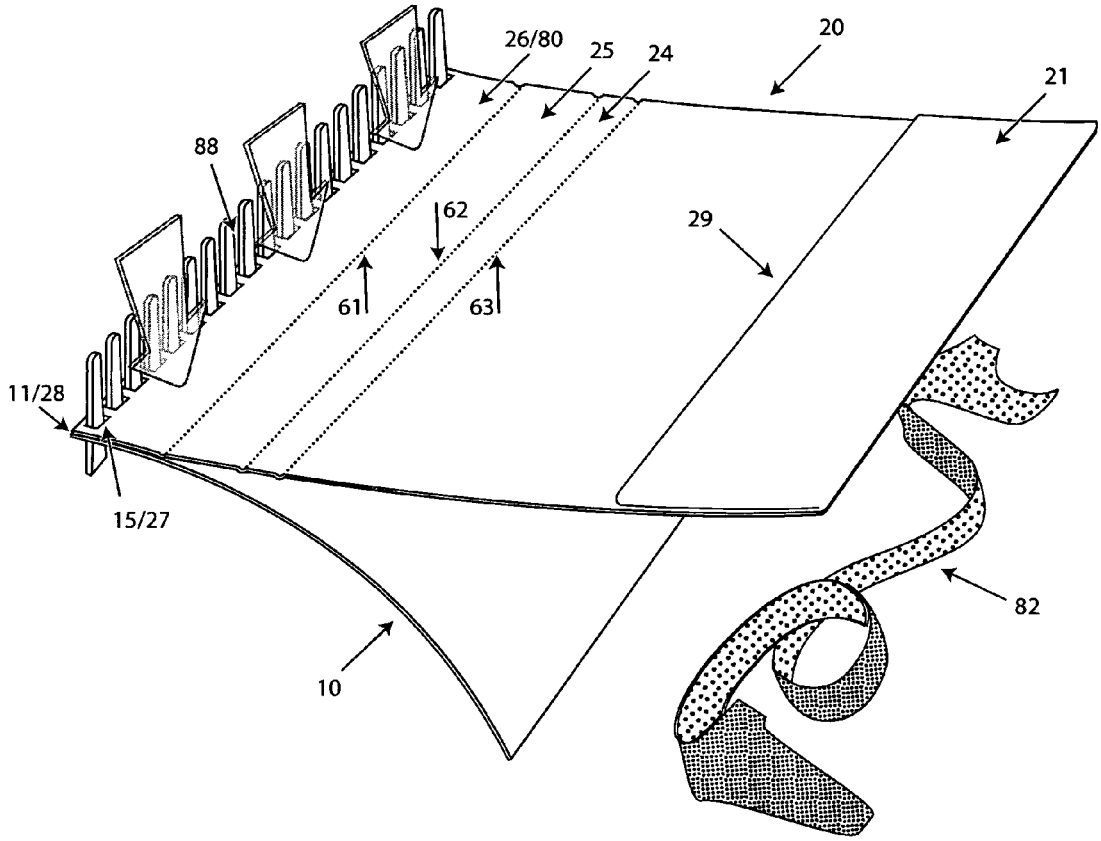

Such dispenser can also provide a protective strip 84 of paper to cover one side of the adhesive simultaneously with application of the adhesive 80 to the cover sheet 82. As a result, the line or strip of contact adhesive 80 is protected between the protective paper 82 and the front cover 10. If the protective paper 82 is removed, one side of the contact adhesive 80 becomes exposed for adhering to another article such as back cover 20. FIG. 7B shows a configuration of the adhesive strip 80 that is fully covered and protected by the cover sheet 82 overlying thereabove. In preparation for the engagement of the front cover 10 and the cover 20, the two pull tabs 86*a* and 86*b* are folded over the cover portion 84 and contact on the upper surface of the front cover 10. As seen in FIG. 7C, this makes it relatively easy for a user to separate the cover sheet 82 by pulling on either of the two pull tabs 86*a* and 86*b*. For engaging the front cover 10 to the cover 20, a jig 88 can be introduced for better alignment and collation of the apertures 15 of the front cover 10 and the apertures 27 of the cover 20. The jig 88 can further facilitate matching and aligning the apertures 35 of the slide 30 and the apertures 51 of the document 50 in the subsequent binding step set forth below. The jig 88 does not require any special manufacturing techniques or materials. Instead, it can be spindles of any type of suitable binding means mentioned above (e.g., plastic comb, plastic coil), which are readily available in office environments. To begin the engagement of the front cover 10 to the cover 20, the jig 88 is positioned for its spindles to be inserted and go through the apertures 15 of the front cover 10, as shown in FIG. 7D. As shown in FIG. 7E, the upward-directed spindles of the jig 88 extend through the apertures 27 of the cover 20 that is positioned above the front cover 10 with the outer side of the cover 20 facing toward the upper surface of the front cover 10. In FIG. 7F, the cover sheet 82 can be removed from the adhesive strip 80 by pulling on either of the two pull tabs 86*a* and 86*b*. As illustrated in FIG. 7G, once the cover sheet 82 is separated from the adhesive strip 80, a user can press the foldback portion 26 against the adhesive strip 80 so that the front cover 10 and cover 20 come into contact and form a firm engagement to hold the covers 10 and 20 together.

Figure 5H:
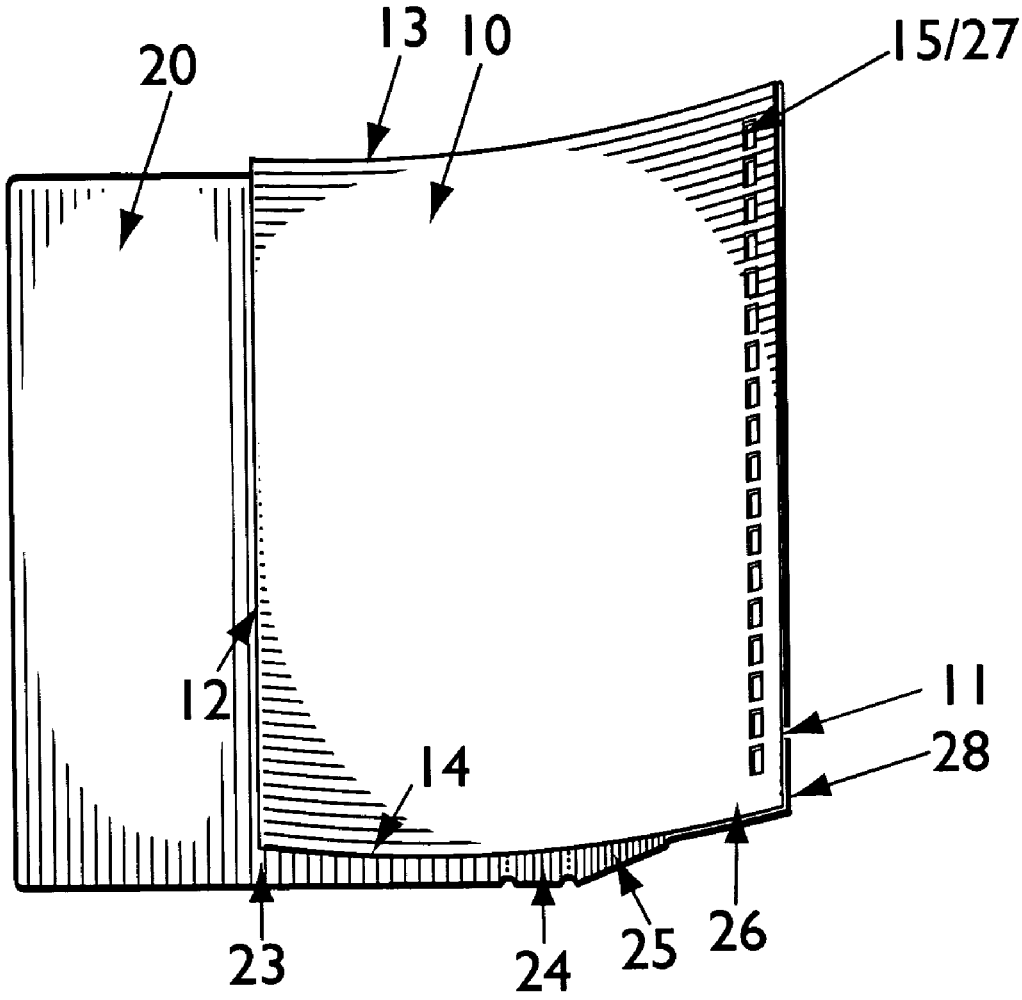
Figure 51:
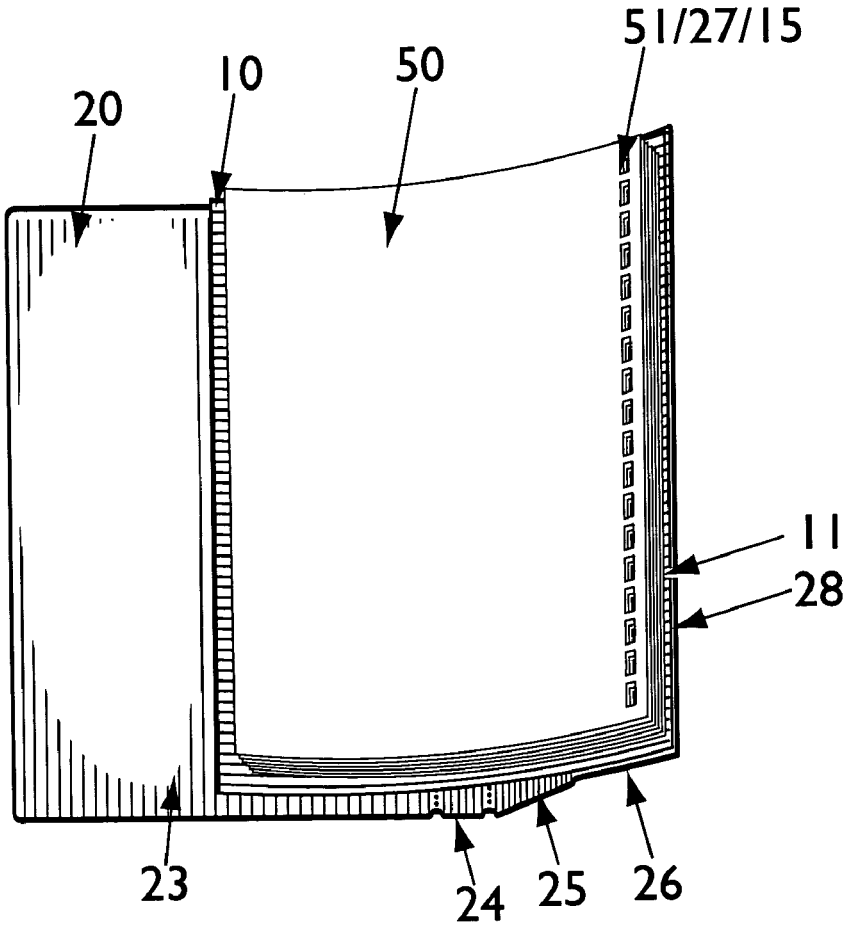
Figure 5J:
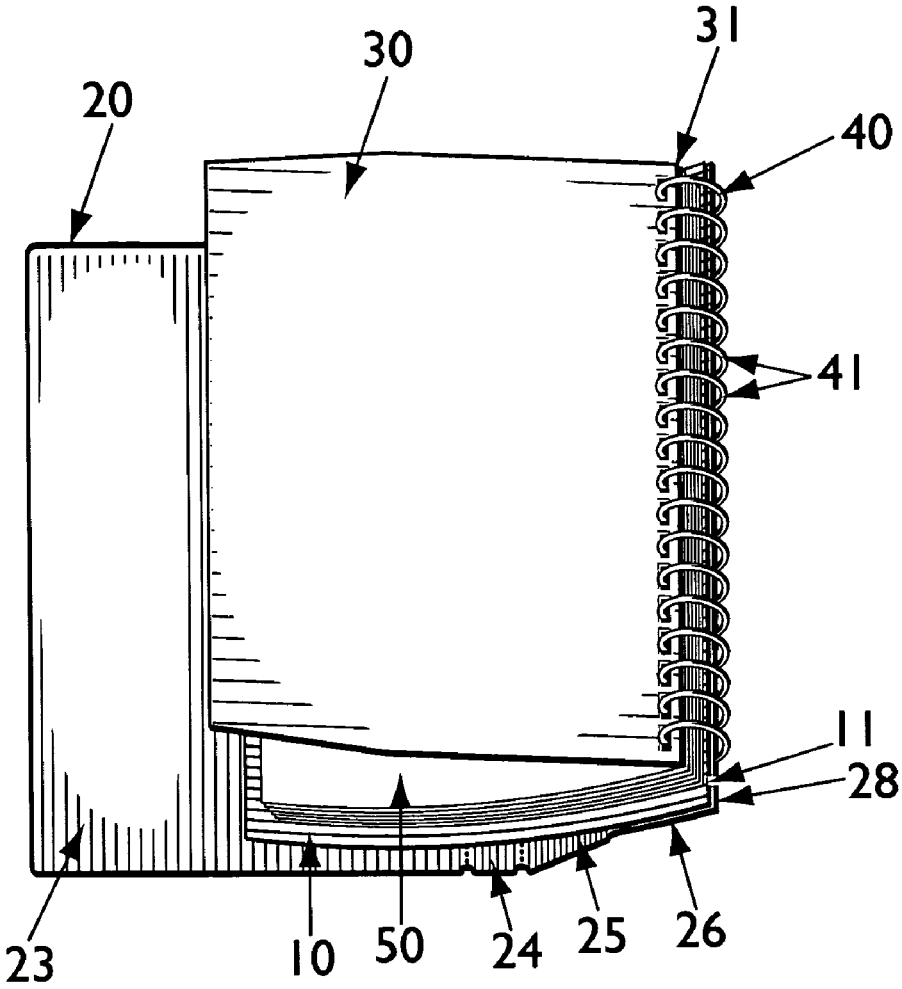
Figure 5K:
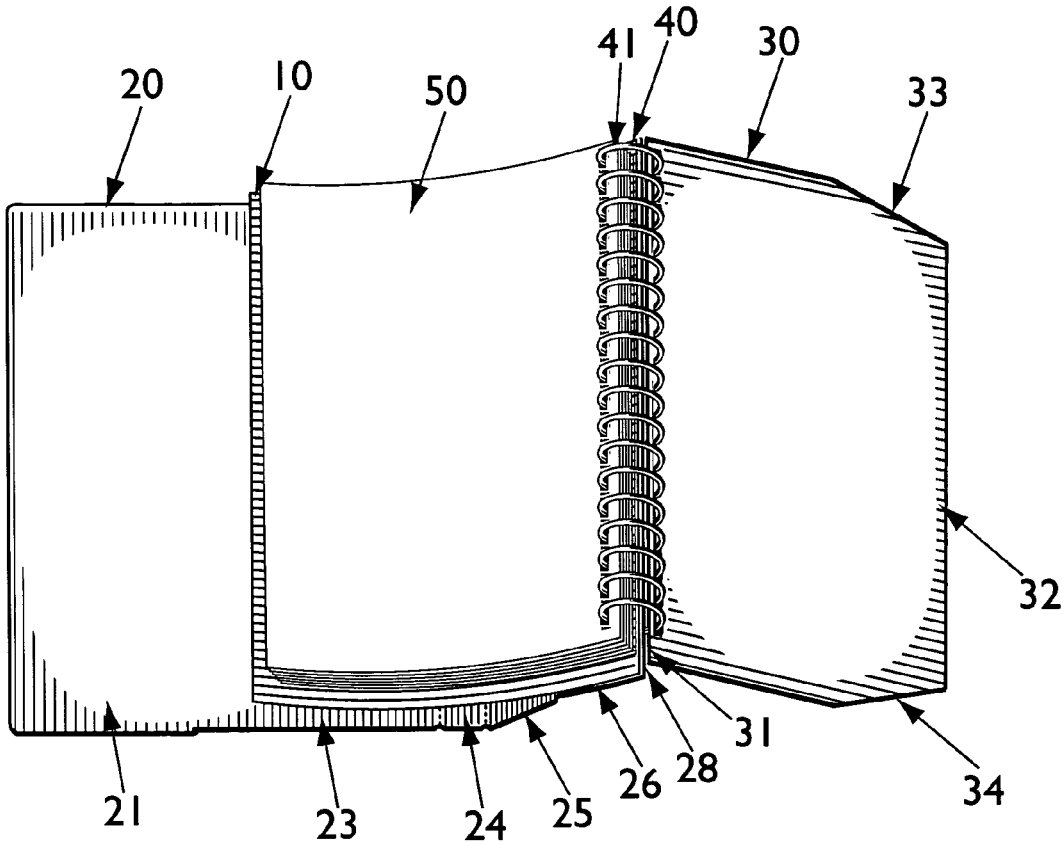
Figure 5L:
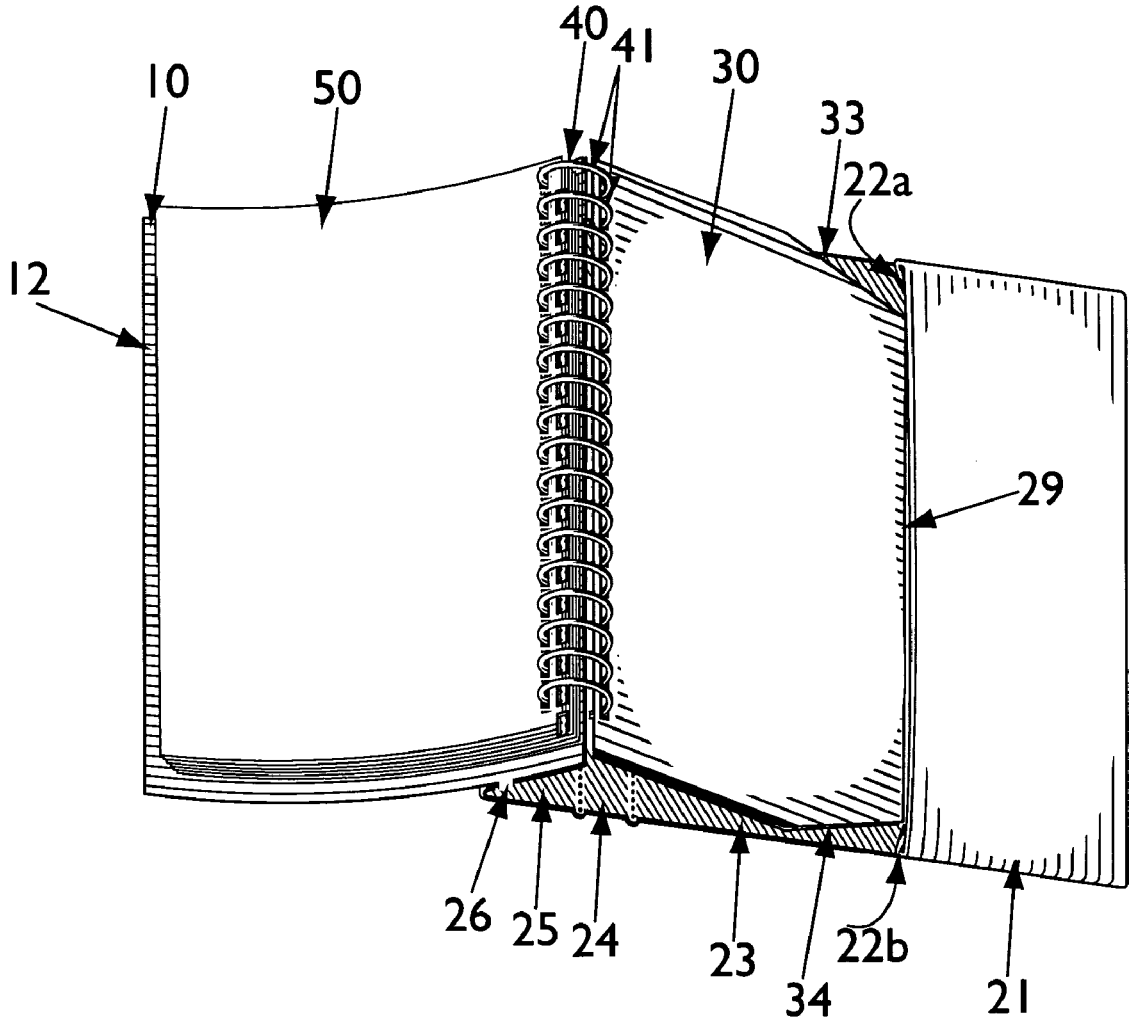
Figure 5M:
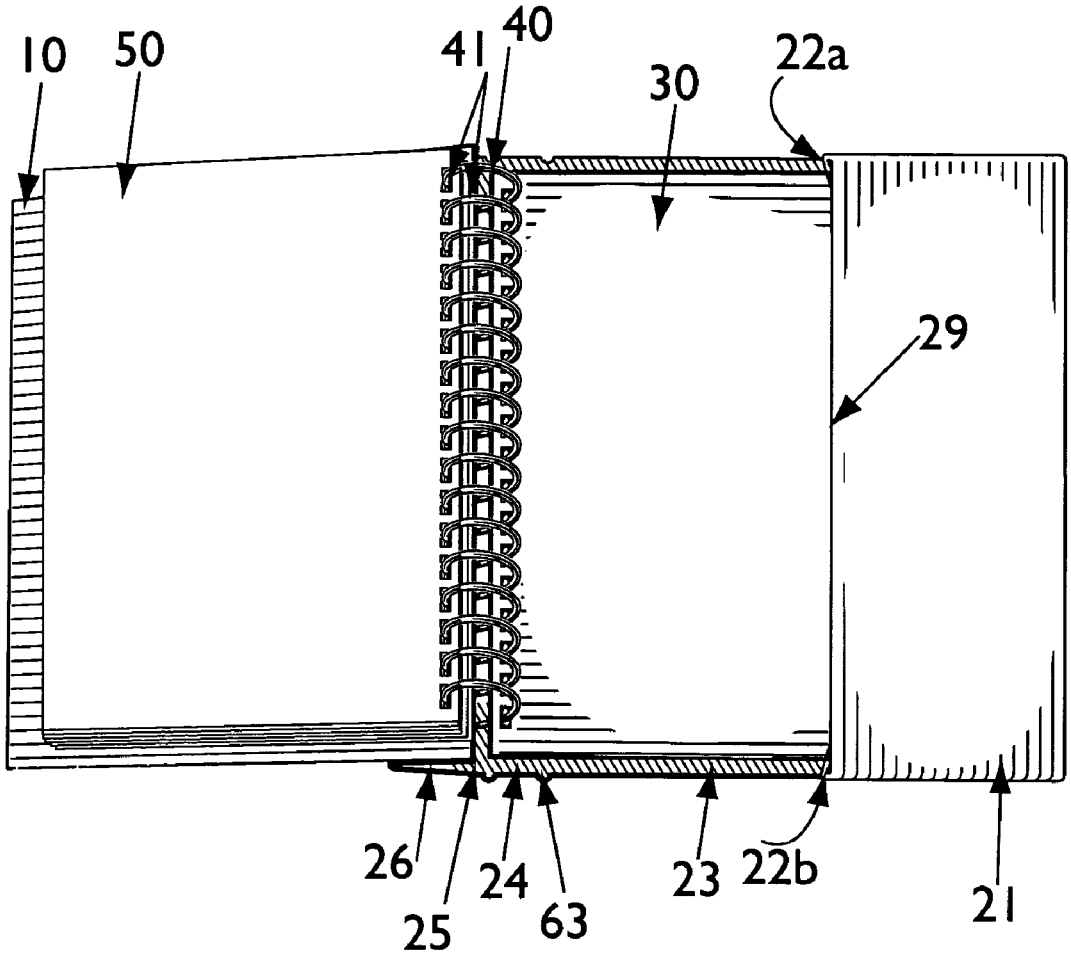

The step of binding begins with the front cover 10 and cover 20 positioned as shown in FIG. 5H. The binding step requires positioning the document 50 onto the front cover 10 as shown in FIG. 5I, and the slide 30 onto the document 50, resulting in that the first sheet of a plurality of sheets constituting the document 50 touches the inner side of the front cover 10 while the last sheet contacts one side of the slide 30. The front cover 10, document 50, and slide 30 are positioned so that all of their edges are substantially aligned and multiple arrays of apertures, including apertures 15 and/or 27, apertures 51 and apertures 35 are matched to receive the binding rings 41 of the binder 40, as shown in FIG. 5J and FIG. 5K. The unbound edge 32 of the slide 30 is inserted into the pocket portion 21 formed on the inner side of the cover 20, as shown in FIG. 5L. The binder assembly 1 is shown in FIG. 5M in its opened position. As seen in FIG. 2, due to the stiffness of the slide 30, the binder assembly 1 is self-supporting if stored in an upright or vertical position. Furthermore, any indicia imprinted on the front cover 10 or the spine portion 24 or the front portion of the cover 20 are clearly visible to a viewer.

Figure 6A:
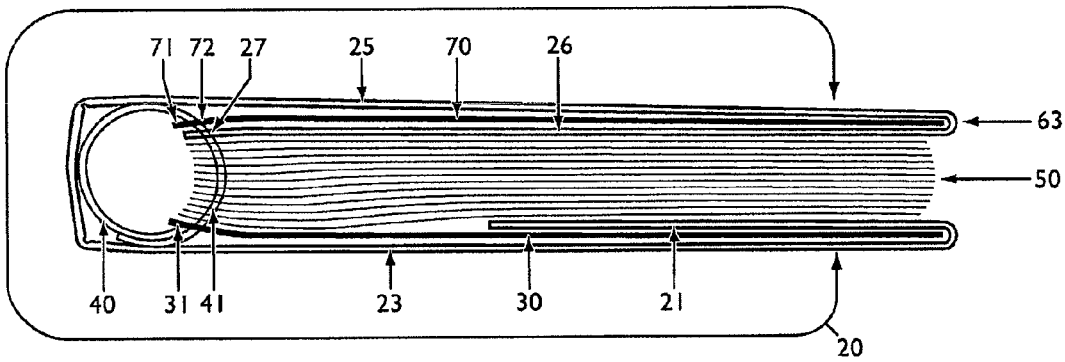
FIGS. 6A-6C depict a series of views of alternative configurations of the binder assembly of FIG. 2.
Figure 6B:
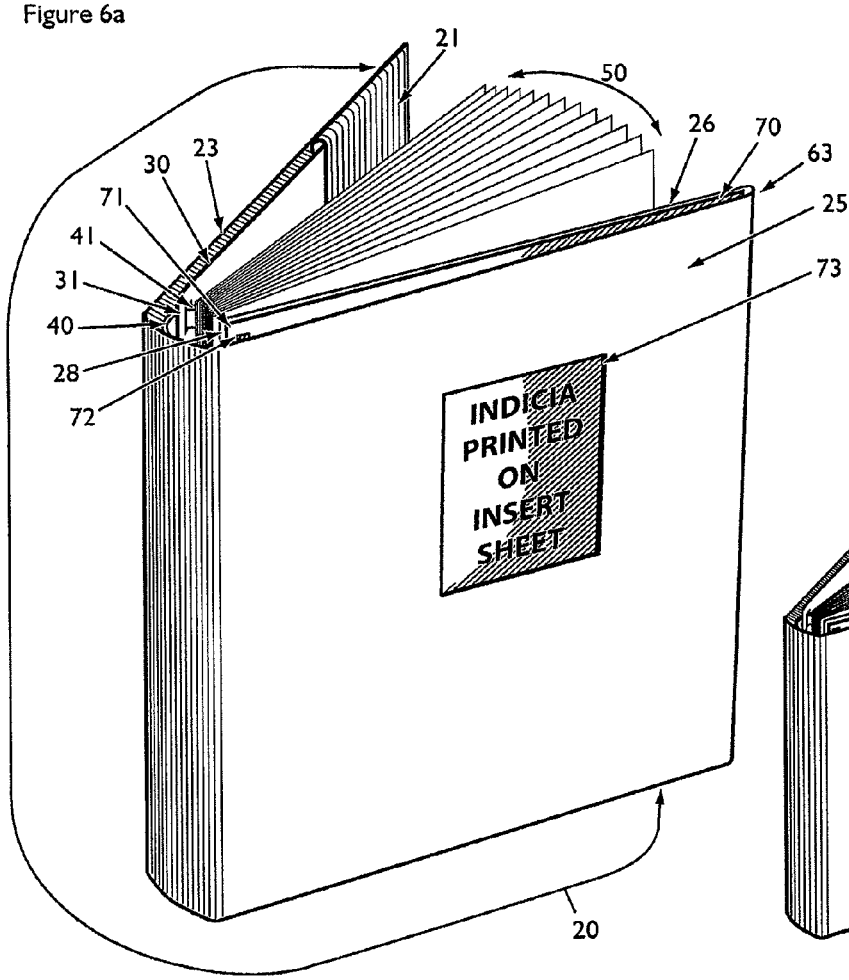
Figure 6C:
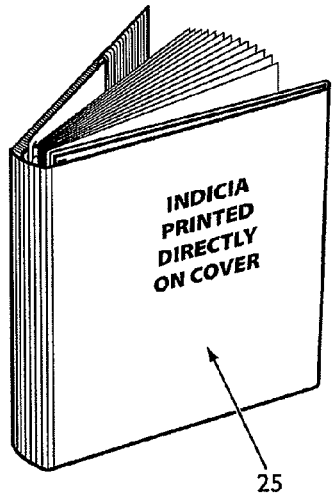

An alternative embodiment of the present invention is illustrated in FIGS. 6A-6C. In this embodiment, the wrap for enclosing the document 50 can be formed from a one-piece cover 20 by varying the dimensions of the front portion 25 and foldback portion 26 defined thereon. As seen in FIG. 6, both the front portion 25 and foldback portion 26 are sized to be the same as the back portion 23, such that in the closed configuration these two portions 25 and 26 can extend all the way from the binder 40 across the width of the document 50. With the foldback portion 26 being folded underneath the front portion 25, an insert sheet 70 can be inserted into and sandwiched between these two portions 25 and 26. The insert sheet 70 defines an engagement portion 71 at one side thereof for engaging to the binder 40, along with the engagement portion 28 of the cover 20 and the slide 30. An array of punched or machined apertures 72 are defined at spaced locations along the engagement portion 71 of the insert sheet 70. In one embodiment, the insert sheet 70 is printed with indicia and positioned between the portions 25 and 26 so that an opening 73 defined in the front portion 25 is aligned with indicia that can be viewed therethrough. To form the wrap in the above alternative configuration, the front portion 25 is folded inwardly about the fold 63 and wrapped around the optional insert sheet 70. As a result, the engagement portion 71 of the insert sheet 70 and the engagement edge 28 of the cover 20 are substantially aligned and apertures 72 and 27 are matched to receive the rings 41 of the binder 40. As readily appreciated by those of ordinary skill in the art, the addition of this insert sheet 70 is optional, and if omitting it, indicia can be directly printed onto the front portion 25 to be viewed. An example of such a document binder assembly with indicia printed directly on front portion 25 is depicted in FIG. 6C.

Figure 8:
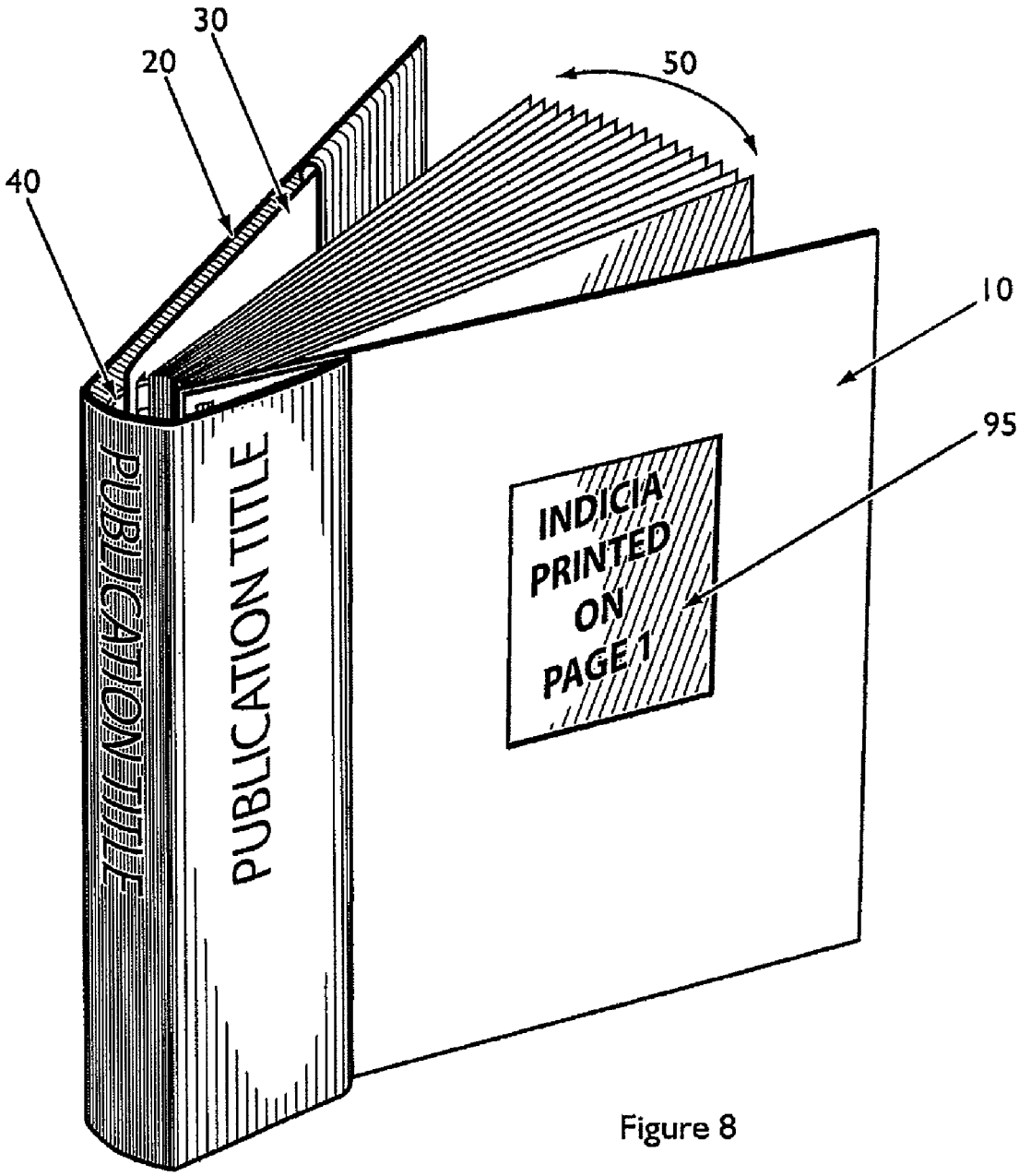
FIG. 8 is a perspective view of a document binder assembly in an embodiment of the present invention wherein the front cover defines an opening wherein indicia on the first page of the document can be viewed therethrough.

An alternative embodiment of the document binder assembly 1 of FIG. 2 is illustrated in FIG. 8. As seen in FIG. 8, the document binder assembly 2 comprises a front cover 10, cover 20, slide 30, binder 40, and document 50. The front cover 10, however, defines an opening 95 wherein indicia on the first page of document 50 can be viewed therethrough.

While the above detailed description with accompanying drawings illustrates several embodiments of the present invention, it will be understood that the invention is not limited to the embodiment disclosed, but may include numerous variations, modifications and substitutions of parts and elements under the assembling principle of the invention.

I claim:

1. A document binder assembly for a document having a multiplicity of sheets, said document binder assembly comprising:

a front cover defining an engagement portion and a front portion;

a back cover formed of one piece of flexible sheet material having an engagement portion, and vertical parallel folds defining a pocket portion and foldback portion;

a slide comprised of a rigid material and having an engagement portion, a top edge, a bottom edge positioned opposite from said top edge, and an unbound edge positioned opposite from the engagement portion, wherein said top edge and bottom edge are configured to be received by said pocket portion; and a binder for holding the multiplicity of sheets, the engagement portion of the slide, the engagement portion of the front cover, and the engagement portion of the back cover;

wherein said foldback portion of the back cover is attached to said front cover, and, to connect the document to the document binder assembly, said unbound edge of said slide is received by the pocket portion of said back cover and wherein the slide is configured as to partially extract from the pocket portion of the back cover when the document binder assembly is opened to permit the document binder assembly to lay flat.

2. The document binder assembly of claim 1, wherein said top edge and bottom edge of said slide are slightly tapered toward the unbound edge of said slide.

3. The document binder assembly of claim 1, wherein the slide is inserted into the pocket portion of the back cover as the document binder assembly is closed to enclose the document.

4. The document binder assembly of claim 1, wherein said slide is composed of a material selected from the group consisting of plastic, paperboard, or cardboard.

5. The document binder assembly of claim 1, wherein said back cover defines a pair of tabs on the upper and lower edges of the back cover which are folded interiorly onto a flap portion defined on the back cover and applied with adhesive, and the flap portion further folds laterally onto the interior surface of the back cover wherein the adhesive holds the tabs thereto to form the pocket portion.

* * * * *

UNITED STATES PATENT AND TRADEMARK OFFICE

CERTIFICATE OF CORRECTION

PATENT NO. : 7,568,853 B2
APPLICATION NO. : 10/846806
DATED : August 4, 2009
INVENTOR(S) : David Laufer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1047 days.

Signed and Sealed this

Seventh Day of September, 2010

David J. Kappos

David J. Kappos
*Director of the United States Patent and Trademark Office*